US010601150B2

(12) United States Patent
Ruland

(10) Patent No.: US 10,601,150 B2
(45) Date of Patent: Mar. 24, 2020

(54) SET SCREW CONNECTOR WITH ANTI-BACKOUT LOCK

(71) Applicant: Hubbell Incorporated, Shelton, CT (US)

(72) Inventor: Rodd Ruland, Amherst, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/180,662

(22) Filed: Nov. 5, 2018

(65) Prior Publication Data

US 2019/0074607 A1 Mar. 7, 2019

Related U.S. Application Data

(63) Continuation of application No. 15/826,175, filed on Nov. 29, 2017, now Pat. No. 10,122,096.

(60) Provisional application No. 62/541,412, filed on Aug. 4, 2017, provisional application No. 62/428,876, filed on Dec. 1, 2016.

(51) Int. Cl.
*H01R 4/36* (2006.01)
*H01R 4/30* (2006.01)

(52) U.S. Cl.
CPC ..... *H01R 4/302* (2013.01); *H01R 4/36* (2013.01)

(58) Field of Classification Search
CPC ..... H01R 4/36; H01R 4/34; H01R 4/302
USPC ..... 439/814, 771, 810, 784
See application file for complete search history.

(56) References Cited

U.S. PATENT DOCUMENTS

| | | | | |
|---|---|---|---|---|
| 2,201,674 | A * | 5/1940 | Rowe | H01R 4/363 439/812 |
| 2,222,156 | A * | 11/1940 | Rowe | H01R 4/30 439/812 |
| 3,775,733 | A | 11/1973 | Ege | |
| 3,876,279 | A | 4/1975 | Underwood | |
| 4,097,112 | A * | 6/1978 | Veldman | H01R 4/34 439/782 |
| 4,269,464 | A * | 5/1981 | Veldman | H01R 4/44 439/782 |
| 4,310,214 | A * | 1/1982 | Carlson | H01R 4/44 439/781 |
| 5,368,506 | A | 11/1994 | Heimbrock | |
| 5,957,733 | A | 9/1999 | Mello | |
| 6,186,839 | B1 * | 2/2001 | Storey | H01R 4/363 439/811 |
| 6,213,818 | B1 | 4/2001 | Chadbourne | |

(Continued)

*Primary Examiner* — Harshad C Patel
(74) *Attorney, Agent, or Firm* — Michael Best & Friedrich, LLP

(57) ABSTRACT

An electrical connector is configured to couple an electrical conductor to a support surface of an electrical device. The electrical connector includes a terminal block having a connecting aperture and a threaded aperture. The connecting aperture is configured to receive the electrical conductor. The electrical connector also includes a fastener having threads receivable within the threaded aperture. The fastener is configured to move in a first rotational direction relative to the threaded aperture. The electrical connector further includes a lock configured to be positioned between the electrical conductor and the fastener to engage the electrical conductor and the fastener. Rotation of the fastener in the first rotational direction causes the lock to secure the electrical conductor against movement relative to the terminal block.

19 Claims, 24 Drawing Sheets

(56) References Cited

U.S. PATENT DOCUMENTS

| | | | | |
|---|---|---|---|---|
| 6,338,658 | B1 | 1/2002 | Sweeney | |
| 6,497,592 | B1 | 12/2002 | Beadle | |
| 6,939,183 | B2 | 9/2005 | Ferretti | |
| 7,537,494 | B1 | 5/2009 | Umlauf | |
| 7,896,714 | B2 | 3/2011 | Moist | |
| 7,946,896 | B2 | 5/2011 | Waltz | |
| 7,996,714 | B2 * | 8/2011 | O'Connell ..... | G06F 11/184 714/11 |
| 8,277,263 | B1 | 10/2012 | Smith | |
| 2003/0124915 | A1 | 7/2003 | Kaine | |
| 2008/0268721 | A1 | 10/2008 | Waltz | |
| 2010/0087083 | A1 | 4/2010 | Skowranek | |
| 2016/0028170 | A1 | 1/2016 | Hyder | |

* cited by examiner

SET SCREW CONNECTOR WITH ANTI-BACKOUT LOCK

REFERENCE TO RELATED APPLICATIONS

This application is a continuation of co-pending U.S. patent application Ser. No. 15/826,175, filed Nov. 29, 2017, which claims the benefit of prior-filed U.S. Provisional Patent Application No. 62/428,876, filed Dec. 1, 2016, and U.S. Provisional Patent Application No. 62/541,412, filed Aug. 4, 2017. The entire contents of these applications are incorporated by reference.

BACKGROUND

The disclosure relates to set screw connectors, and more specifically to set screw connectors used to join electrical conductors (e.g., conductive wire) to electrical devices and/or other electrical conductors.

SUMMARY

The disclosure relates to inhibiting either accidental or purposeful removal or loosening movement (e.g., "backing off") of one or more set screws from their intended position (e.g., after initial installation of the connector). Such removal or loosening movement can have a deleterious effect on the integrity of the electrical connection, resulting in high resistance, thermal runaway, and system ineffectiveness that can compound over time and potentially result in damage to the system.

In one aspect, an electrical connector is configured to couple an electrical conductor to a support surface of an electrical device. The electrical connector includes a terminal block having a connecting aperture and a threaded aperture. The connecting aperture is configured to receive the electrical conductor. The electrical connector also includes a fastener having threads receivable within the threaded aperture. The fastener is configured to move in a first rotational direction relative to the threaded aperture. The electrical connector further includes a lock configured to be positioned between the electrical conductor and the fastener to engage the electrical conductor and the fastener. Rotation of the fastener in the first rotational direction causes the lock to secure the electrical conductor against movement relative to the terminal block.

In another aspect, an electrical connector is configured to couple an electrical conductor to a support surface of an electrical device. The electrical connector includes a terminal block having a connecting aperture and a threaded aperture. The connecting aperture is configured to receive the electrical conductor. The electrical connector also includes a lock having threads to be receivable within the threaded aperture. The lock is configured to move in a first rotational direction about an axis to secure the electrical conductor against movement relative to the terminal block. The lock is configured to move in a second rotational direction about the axis to release the electrical conductor from the terminal block. The electrical connector further includes a locking fastener engageable with the lock. A force is exerted on a portion of one of the lock and the locking fastener in a radial direction relative to the axis to inhibit movement of the lock in the second rotational direction.

In yet another aspect, an electrical connector is configured to couple an electrical conductor to a support surface of an electrical device. The electrical connector includes a terminal block having a first aperture and a second aperture. The first aperture is configured to receive the electrical conductor. The electrical connector also includes a locking fastener receivable within the second aperture. The locking fastener is configured to move into a first position in which the electrical conductor is secured against movement relative to the terminal block. The locking fastener is configured to move into a second position in which the electrical conductor is releasable from the terminal block. The electrical connector further includes a lock engaging the locking fastener to inhibit movement of the locking fastener from the first position to the second position. The lock disengages the locking fastener to permit movement of the locking fastener from the first position to the second position.

Other aspects of the disclosure will become apparent by consideration of the detailed description and accompanying drawings

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
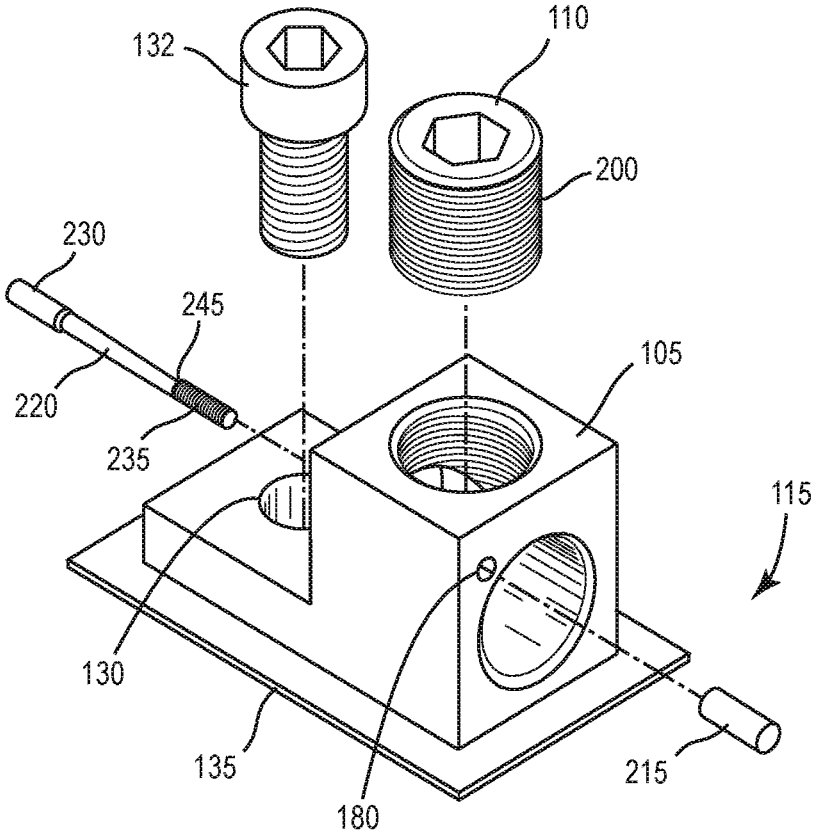
FIG. 1 is an exploded view of an electrical connector including a terminal block, a set screw, and an anti-backout lock.
Figure 2:
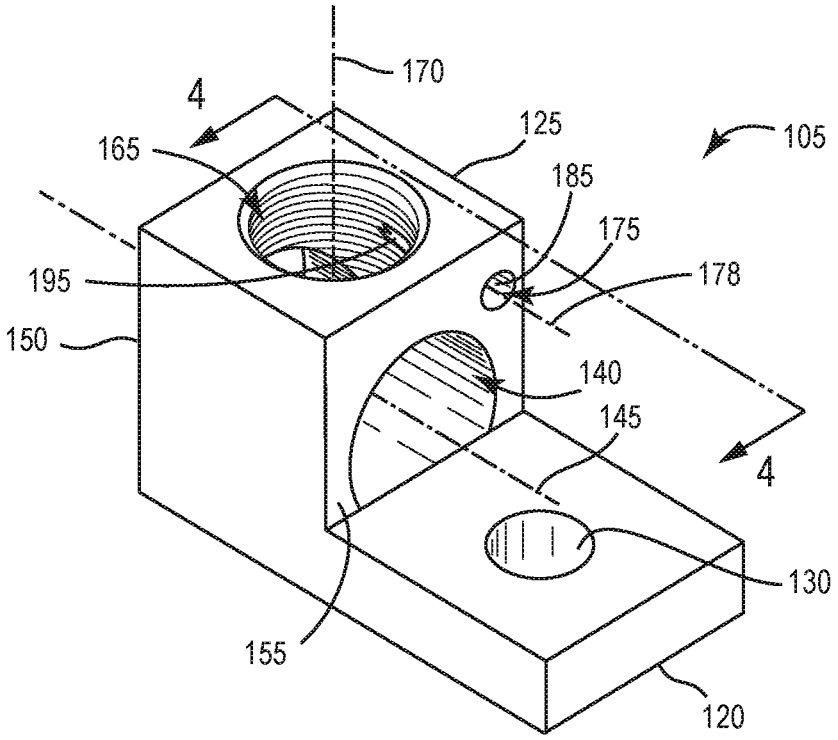
FIG. 2 is a first perspective view of the terminal block of FIG. 1.
Figure 3:
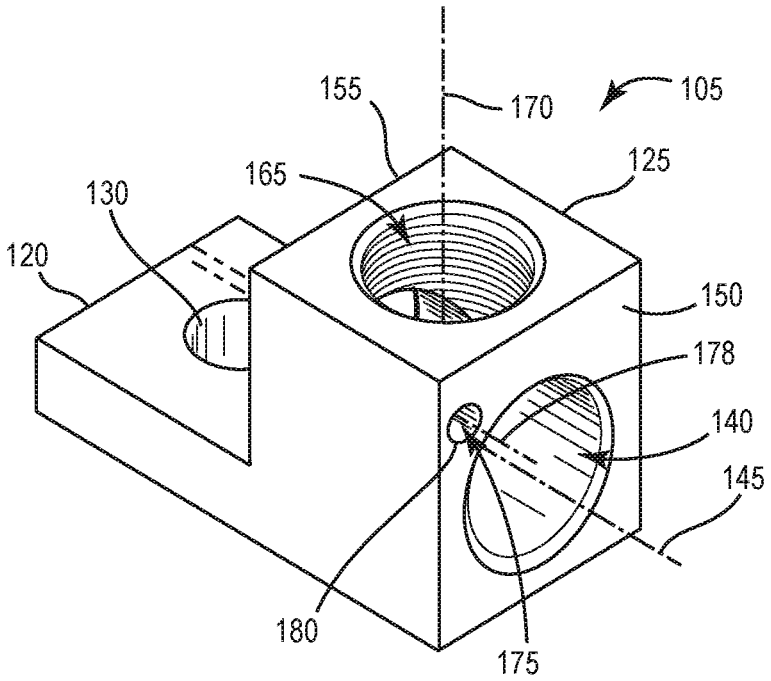
FIG. 3 is a second perspective view of the terminal block of FIG. 2.

FIG. 1 illustrates a universal-type electrical connector 100 including a terminal block 105, a set screw 110 (e.g., clamp, locking fastener, etc.), and an anti-backout lock 115. As best shown in FIGS. 2 and 3, the illustrated terminal 105 includes a first or base portion 120 coupled to a second or raised portion 125. The base portion 120 includes a mounting aperture 130 sized to receive a fastener 132 to fasten the electrical connector 100 to a support surface 135 (FIG. 1). In one embodiment, the support surface 135 can be a portion of an electrical device (e.g., the electrical connector 100 can be coupled to the support surface 135 of a busbar, and the busbar can electrically ground an electrical circuit of the electrical device). In further embodiments, the electrical connector 100 can be coupled externally to a panel, such as a pad mounted transformer, a ground grid for a solar panel, a multi-port insulated connector for building wiring, etc.

The illustrated raised portion 125 includes a connecting aperture 140 defining a central axis 145 extending between a first end surface 150 of the raised portion 125 and a second end surface 155. The first end surface 150 is distal from the base portion 120 and the second end surface 155 is proximal to the base portion 120 in a direction along the central axis 145 of the connecting aperture 140. The connecting aperture 140 is sized to receive an electrical conductor 160 (e.g., conductive wire, conductive bar, etc.). The raised portion 125 also includes a threaded aperture 165 that is in communication with the connecting aperture 140 with the threaded aperture 165 defining a central axis 170 that is transverse to the central axis 145 of the connecting aperture 140. In the illustrated embodiment, the raised portion 125 is positioned further from the support surface 135 than the base portion 120 in a direction along the central axis 170 of the threaded aperture 165 to define the L-shaped terminal block 105.

Figure 4:
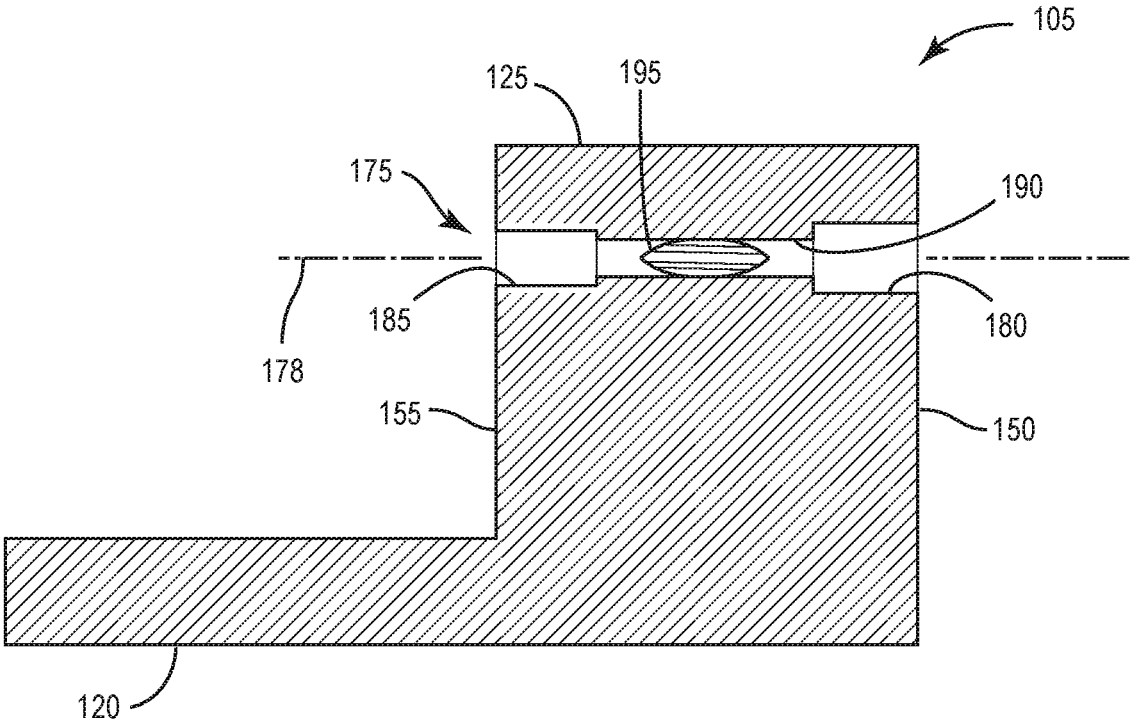
FIG. 4 is a cross sectional view of the terminal block of FIG. 2 viewed along section 4-4.

Referring to FIGS. 2-4, the raised portion 125 further includes an anti-backout lock aperture 175 defining a central axis 178 that is substantially parallel to the central axis 145 of the connecting aperture 140 but is substantially perpendicular to the central axis 170 of the threaded aperture 165. As best shown in FIG. 4, the illustrated anti-backout lock aperture 175 includes a first counter-bore 180 positioned on the same side of the raised portion 125 as the first end surface 150, a second counter-bore 185 positioned on the same side of the raised portion 125 as the second end surface 155, and an intermediate portion 190 connecting the first and second counter-bores 180, 185 together. In the illustrated embodiment, the first counter-bore 180 and the intermediate portion 190 are concentric about the central axis 178 of the anti-backout lock aperture 175, but the second counter-bore 185 is offset away from the connecting aperture 140 (e.g., eccentric) relative to the central axis 178 of the anti-backout lock aperture 175. In addition, an opening 195 is formed between the intermediate portion 190 and the threaded aperture 165 to provide communication between the threaded aperture 165 and the anti-backout lock aperture 175 (FIGS. 2 and 4).

Referring again to FIG. 1, the set screw 110 includes threads 200 that are sized to engage the threaded aperture 165. The illustrated set screw 110 is configured to be engaged by a tool (e.g., a hex-shaped driver bit) to be rotatable about the central axis 170 of the threaded aperture 165 in a first direction 205 (FIGS. 6 and 7) to move the set screw 110 into the threaded aperture 165 or a second direction 210 (FIGS. 6 and 7) to move the set screw 110 out of the threaded aperture 165.

Figure 5:
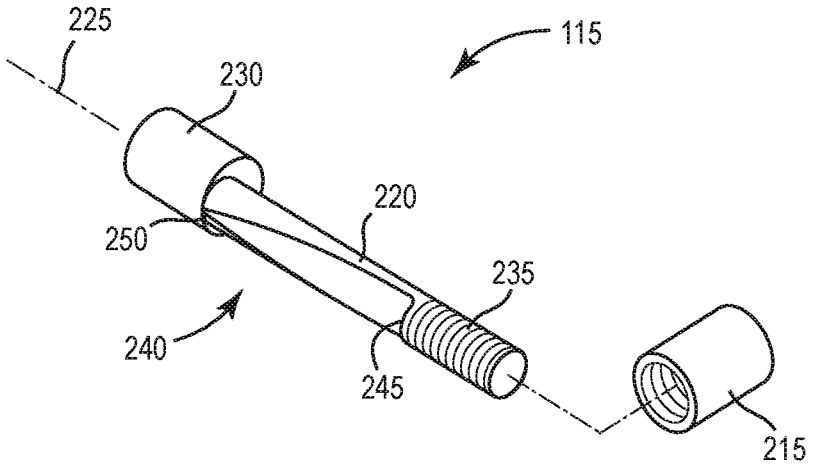
FIG. 5 is an exploded view of the anti-backout lock of FIG. 1.

FIG. 5 illustrates the anti-backout lock 115 that includes a cap 215 and a shaft 220. The illustrated shaft 220 extends along a longitudinal axis 225 and includes a flange 230 (e.g., a cylindrical protrusion) located on one end of the shaft 220 and a threaded portion 235 located on an opposite end of the shaft 220. The illustrated flange 230 is offset about the longitudinal axis 225 (e.g., eccentrically coupled to the shaft 220; FIG. 5), and the cap 215 is concentric about the longitudinal axis 225. In other embodiments, the cap 215 can be offset about the longitudinal axis 225, and the flange 230 can be concentric about the longitudinal axis 225. The illustrated shaft 220 also includes a wedge or abutment surface 240 having a recessed end 245 and an abutment end 250 located between the threaded portion 235 and the flange 230. The illustrated wedge surface 240 is a planar recess into the shaft 220 and is oriented at an oblique angle relative to the longitudinal axis 225 of the shaft 220 (e.g., the recessed end 245 is positioned closer to the longitudinal axis 225 than the abutment end 250). In other embodiments, the wedge surface 240 can be at least partially curved relative to the longitudinal axis 225.

To assemble the electrical connector 100, the shaft 220 is inserted into the anti-backout lock aperture 175 so that the wedge surface 240 faces the opening 195. In the illustrated embodiment, the flange 230 is received within the second counter-bore 185 so that at least a portion of the threaded portion 235 extends into the first counter-bore 180. The cap 215 is then threadably coupled to the threaded portion 235 so that the cap 215 is received within the first counter-bore 180. Because the flange 230 is offset from the longitudinal axis 225 of the shaft 220, the anti-backout lock 115 is inhibited from rotating about the longitudinal axis 225 ensuring that the wedge surface 240 is always facing the opening 195. In other embodiments, the flange 230 can include a flat surface that interfaces with a flat surface formed in the second counter-bore 185 to inhibit rotation of the anti-backout lock 115 about the longitudinal axis 225. In further embodiments, the flange 230 is received within the first counter-bore 180 and the cap 215 is received within the second counter-bore 185. In addition, the set screw 110 is threadably coupled to the threaded aperture 165 so that a portion of the threads 200 extend into the anti-backout lock aperture 175 through the opening 195.

Figure 6:
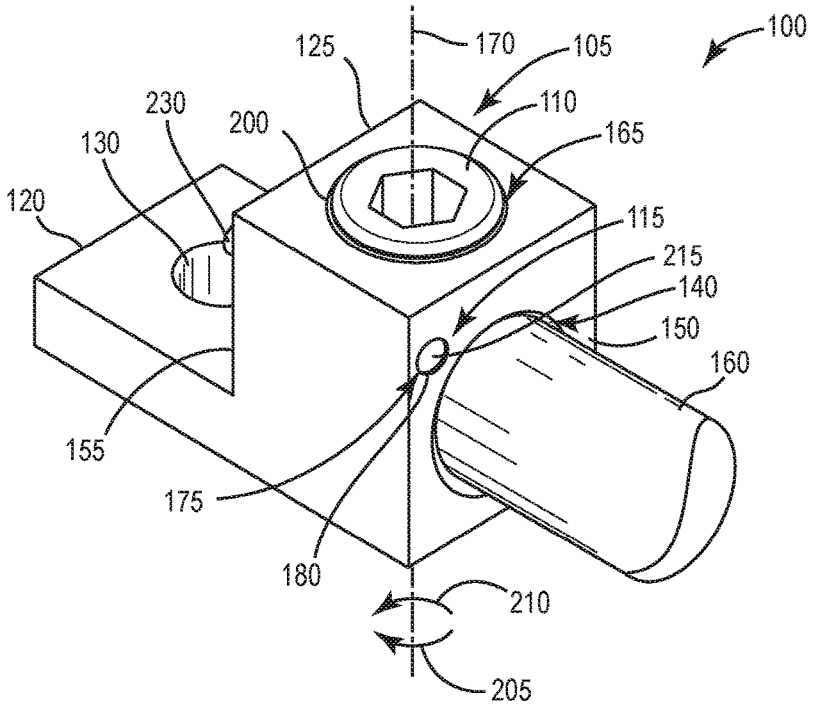
FIG. 6 is a perspective view of the electrical connector of FIG. 1 in an unlocked state allowing movement of the set screw.

The illustrated anti-backout lock 115 is translatable between an unlocked position (FIG. 6) and a locked position (FIG. 7) in a direction along the longitudinal axis 225 (e.g., perpendicular to the central axis 170 of the threaded aperture 165). With reference to FIG. 6, the anti-backout lock 115 is in the unlocked position so that the set screw 110 is rotatable in either direction 205, 210. In particular, the wedge surface 240 is spaced from and does not engage the threads 200 of the set screw 110 (e.g., the recessed end 245 is positioned closer to the opening 195 than the abutment end 250) by pushing the cap 215 in a direction toward the second end surface 155 of the raised portion 125. As a result, the flange 230 extends outwardly beyond the second end surface 155. When the anti-backout lock 115 is in the unlocked position, the electrical conductor 160 can be inserted into the connecting aperture 140 until the electrical conductor 160 abuts the base portion 120 (e.g., to ensure proper depth of the electrical conductor 160 within the connecting aperture 140) and the set screw 110 can be rotated in the first direction 205 to clamp and secure the electrical conductor 160 to the terminal 105.

Figure 7:
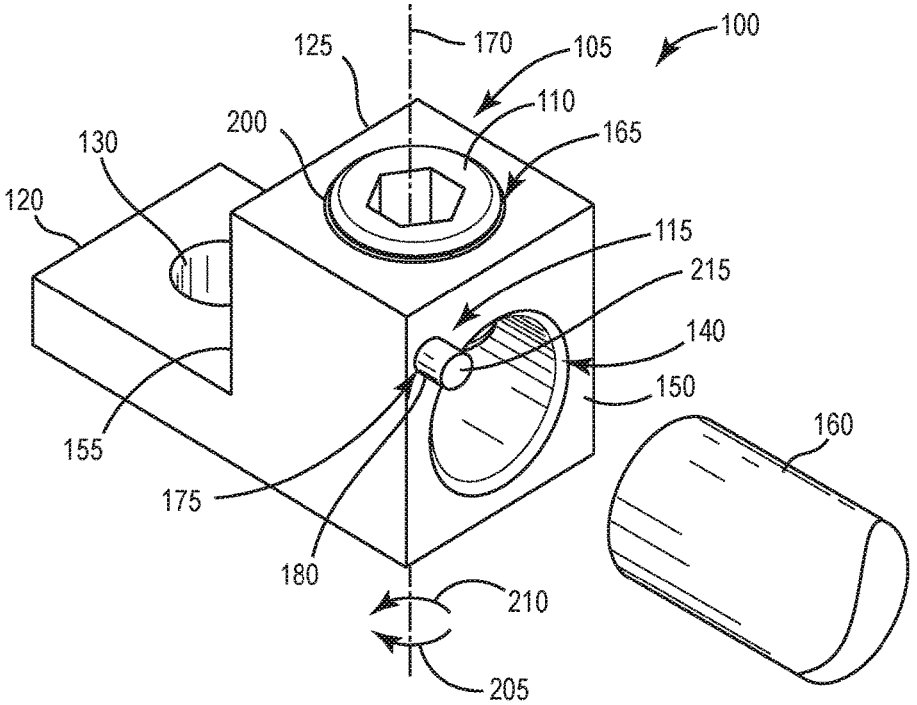
FIG. 7 is a perspective view of the electrical connector of FIG. 1 in a locked state inhibiting movement of the set screw.

In order to prevent loosening or "backing off" of the set screw 110 (e.g., by an installer during installation or a maintenance process, due to the effects of thermal influence on the electrical connector 100, or due to vibrations imparted on the electrical connector 100/electrical device during use) from the set screw's 110 intended position within the terminal 105, the anti-backout lock 115 is moved into the locked position (FIG. 7). By pushing the flange 230 in a direction toward the first end surface 150 so that the flange 230 is fully seated within the second counter-bore 185, the abutment end 250 of the wedge surface 240 is moved into contact with the portion of the threads 200 that extend into the anti-backout lock aperture 175 through the opening 195 and the cap 215 extends outwardly beyond the first end surface 150. In particular, any movement of the set screw 110 in the second direction 210 acts on the wedge surface 240 and tries to move the wedge surface 240 toward the first end surface 150. However, the wedge surface 240 cannot move toward the first end surface 150 because the flange 230 is fully seated within the second counter-bore 185. As a result, the anti-backout lock 115 provides a wedge between the set screw 110 and the terminal 105 to inhibit movement of the set screw 110 in the second direction 210. Such contact between the wedge surface 240 and the set screw 110 ensures that the electrical conductor 160 is securely maintained within the terminal 105 by inhibiting the set screw 110 from rotating in the second direction 210, which would loosen the set screw 110 from its intended position.

In other embodiments, the anti-backout lock 115 can be a thread lock compound (e.g., a nylon coating, an epoxy coating, etc.) applied to the threads 200 of the set screw 110, the threaded aperture 165, or both the threads 200 and the threaded aperture 165. As such, the anti-backout lock aperture 175 of the terminal block 105, the cap 215, and the shaft 220 can be omitted from the electrical connector 100. The thread lock compound inhibits the set screw 110 from rotating relative to terminal block 105 once the set screw 110 is threaded into the threaded aperture 165 to a desired amount.

Figure 8:
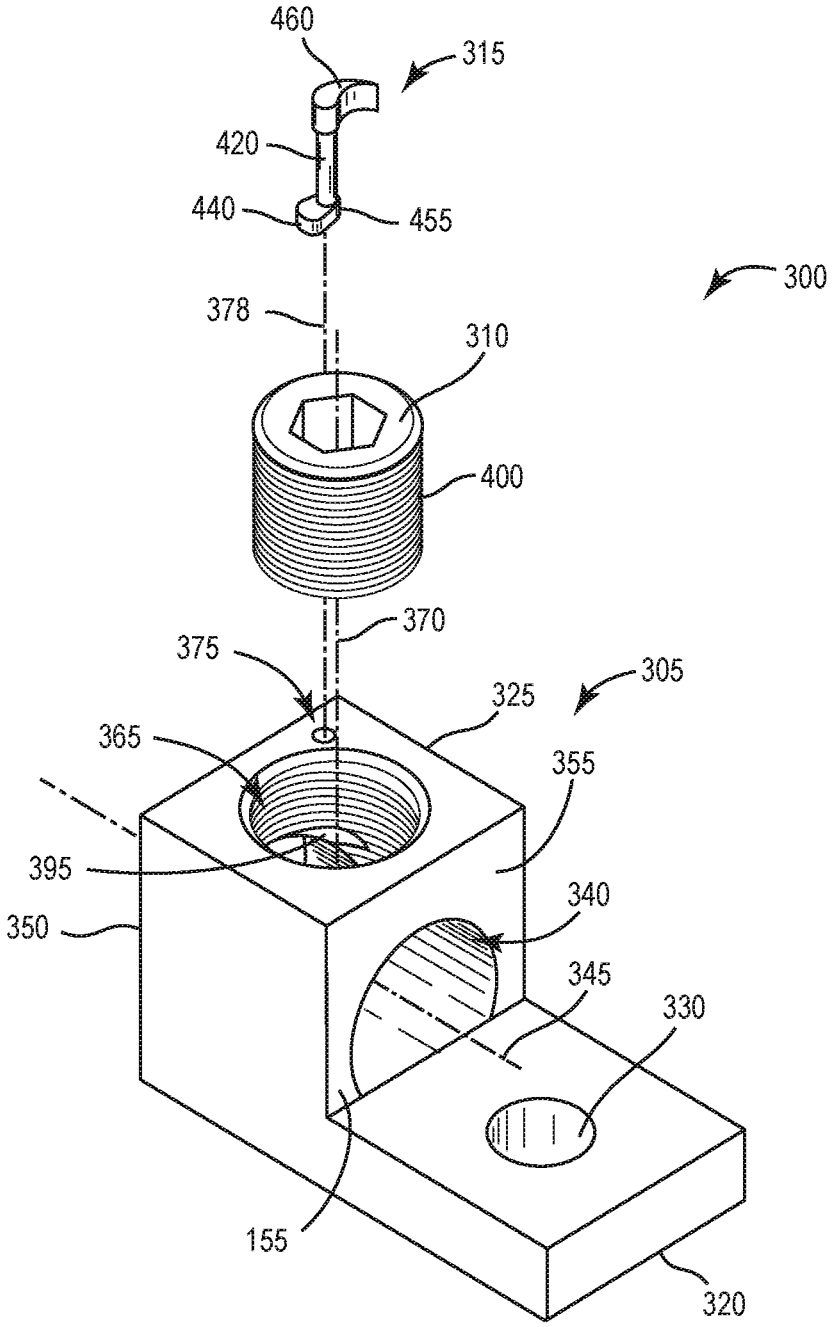
FIG. 8 is an exploded view of an electrical connector including a terminal block, a set screw, and an anti-backout lock according to another embodiment.
Figure 9:
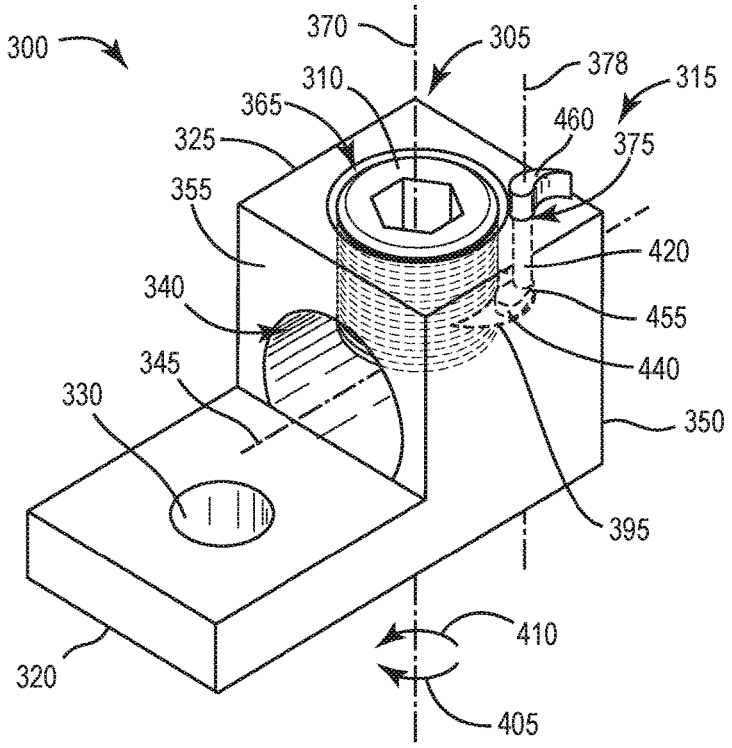
FIG. 9 is a perspective view of the electrical connector of FIG. 8 in an unlocked state allowing movement of the set screw.
Figure 10:
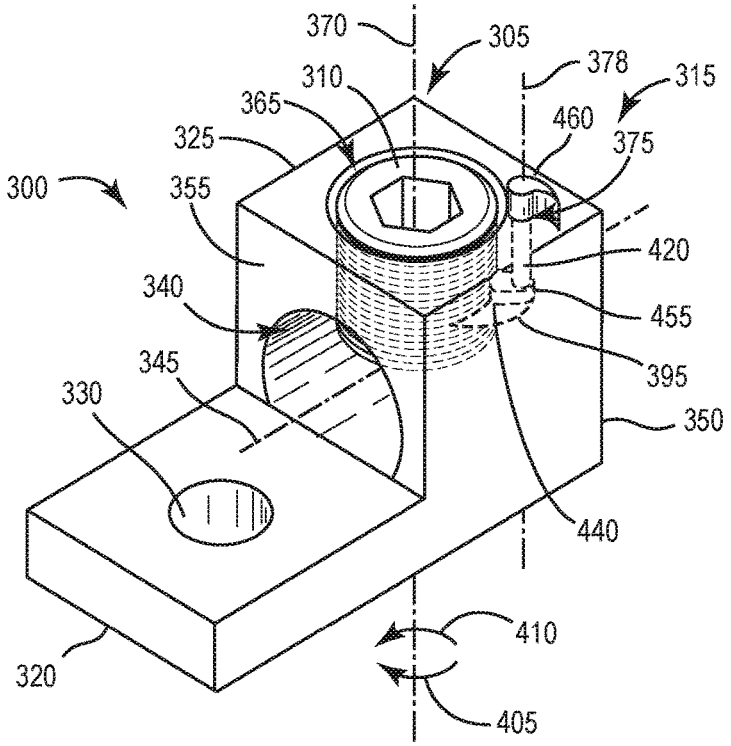
FIG. 10 is a perspective view of the electrical connector of FIG. 8 in a locked state inhibiting movement of the set screw.

FIGS. 8-10 illustrate an electrical connector 300 according to another embodiment. The electrical connector 300 is similar to the electrical connector 100; therefore, similar components are designated with similar reference numbers plus 200, and only the differences between the electrical connectors 100, 300 will be discussed in detail. In addition, components or features described with respect to only one or some of the embodiments described herein are equally applicable to any other embodiments described herein.

FIG. 8 illustrates the electrical connector 300 including a terminal block 305, a set screw 310, and an anti-backout lock 315. The illustrated terminal block 305 includes a base portion 320 having a mounting aperture 330 and a raised portion 325 having a connecting aperture 340 defining a central axis 345. The terminal block 305 also includes a first end surface 350 distal from the base portion 320 and a second end surface 355 proximal to the base portion 320. The raised portion 325 includes a threaded aperture 365 defining a central axis 370 and is sized to engage threads 400 of the set screw 310 so that the set screw 310 is rotatable in either a first direction 405 or a second direction 410 (FIGS. 9 and 10). The raised portion 325 further includes an anti-backout lock aperture 375 defining a central axis 378 that is substantially parallel to the central axis 370 of the threaded aperture 365 but is substantially perpendicular to the central axis 345 of the connecting aperture 340. An opening 395 (e.g., cavity) is formed at an end of the anti-backout lock aperture 375 to provide communication between the threaded aperture 365 and the anti-backout lock aperture 375.

The illustrated anti-backout lock 315 includes a cam lock member 455 having a wedge or abutment surface 440 coupled to a shaft 420 at one end and an actuator 460 (e.g., a handle) fixedly coupled to the shaft 420 at the other end. In the illustrated embodiment, the cam lock member 455 is made of a material that is softer than the set screw 310 (e.g., rubber, plastic, or the like).

To assemble the anti-backout lock 315 onto the terminal block 305, the cam lock 455 is positioned within the opening 395 and the shaft 420 is inserted into the anti-backout lock aperture 375 so that the shaft 420 engages (e.g., threadably engages) the cam lock member 455 to fixedly couple the shaft 420 to the cam lock 455. The handle 460 extends beyond an upper surface of the raised portion 325 so that the operator can rotate the cam lock member 455 between an unlocked position (FIG. 9) and a locked position (FIG. 10).

In the unlocked position (FIG. 9), the cam lock 455 is rotated into the opening 395 by the handle 460 so that no portion of the cam lock 455 extends into the threaded aperture 365. As a result, the set screw 310 can be rotated in either direction 405, 410 without the cam lock 455 engaging the threads 400 of the set screw 310. In the unlocked position, the electrical conductor 160 can be installed to the electrical connector 300.

In the locked position (FIG. 10), the cam lock 455 is rotated out of the opening 395 (e.g., parallel to the first direction 405) by the handle 460 so that the wedge surface 440 is at least partially positioned within the anti-backout lock aperture 375. In the illustrated embodiment, the wedge surface 440 is angled into the second direction 410 so that any movement of the set screw 310 in the second direction 410 will act to compress the cam lock 455. As a result, the wedge surface 440 engages the threads 400 of the set screw 310 and the set screw 310 is inhibited from rotating in at least the second direction 410 (e.g., the cam lock 455 is wedged between the set screw 310 and the terminal block 305) to securely maintain the electrical conductor 160 within the electrical connector 300.

Figure 11:
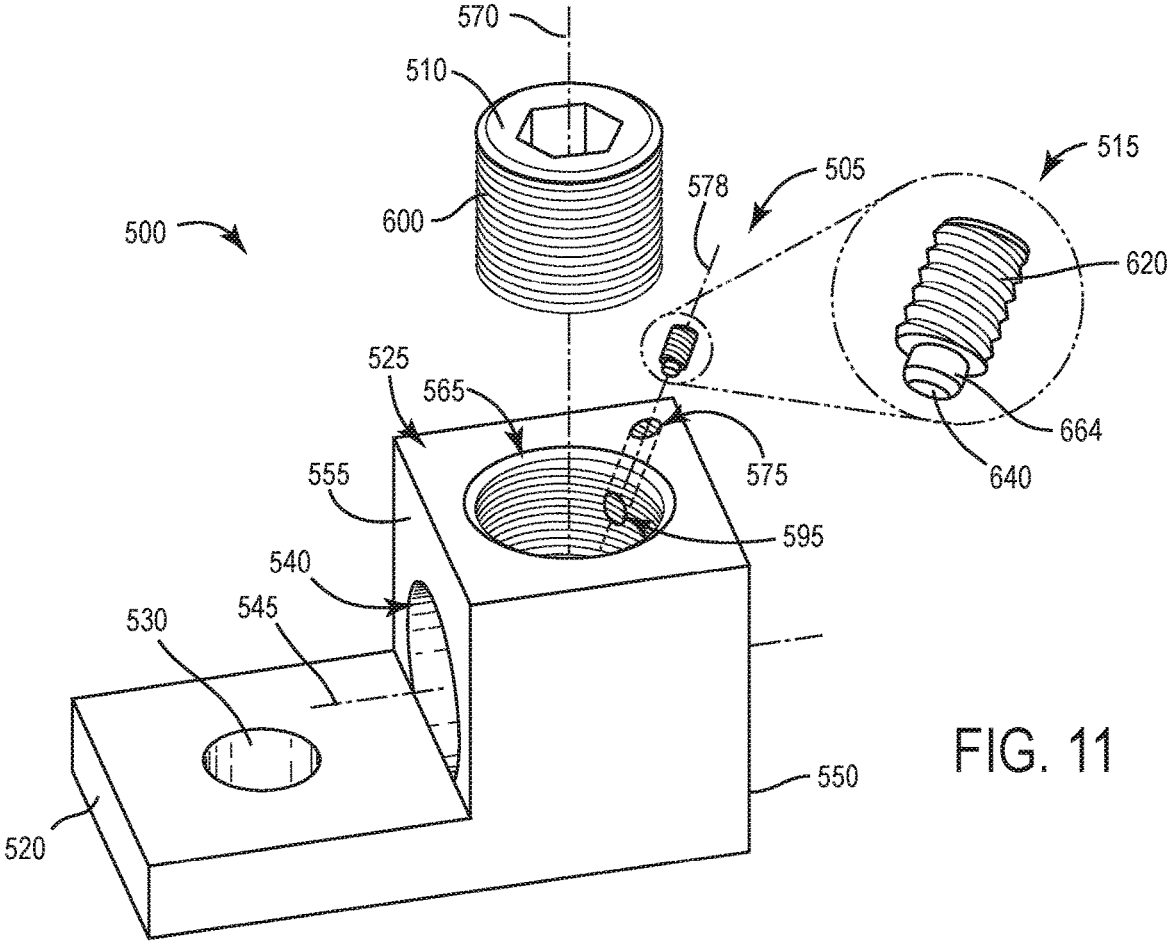
FIG. 11 is an exploded view of an electrical connector including a terminal block, a set screw, and an anti-backout lock according to another embodiment.
Figure 12:
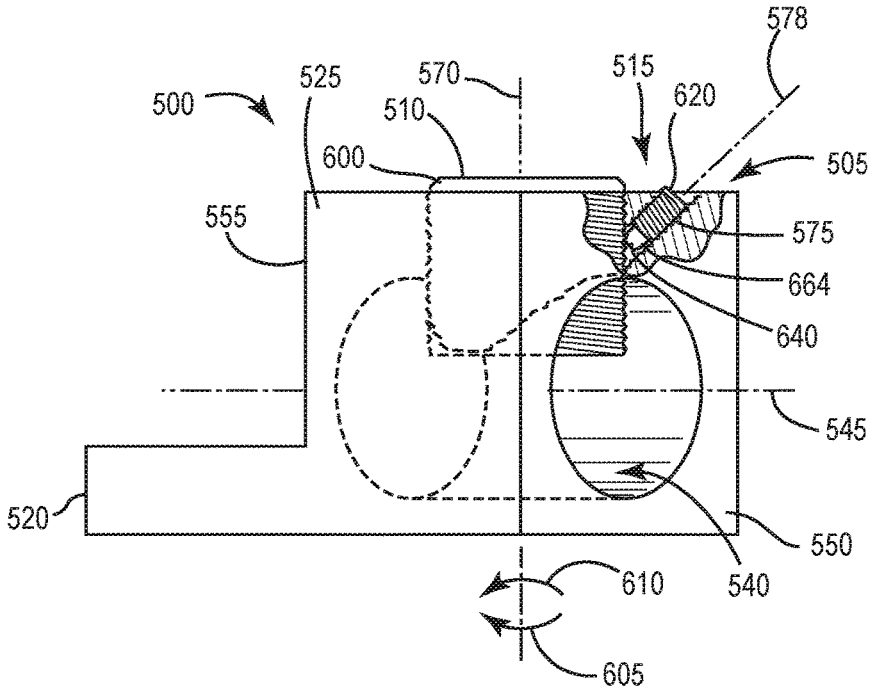
FIG. 12 is a perspective view of the electrical connector of FIG. 11 in a locked state inhibiting movement of the set screw.

FIGS. 11 and 12 illustrate an electrical connector 500 according to another embodiment. The electrical connector 500 is similar to the electrical connector 100; therefore, similar components are designated with similar reference numbers plus 400, and only the differences between the electrical connectors 100, 500 will be discussed in detail. In addition, components or features described with respect to only one or some of the embodiments described herein are equally applicable to any other embodiments described herein. As such, the electrical connector 500 may have similar components to other embodiments previously described herein with the similar components including similar reference numbers.

FIG. 11 illustrates the electrical connector 500 including a terminal block 505, a set screw 510, and an anti-backout lock 515. The illustrated terminal block 505 includes a base portion 520 having a mounting aperture 530 and a raised portion 525 having a connecting aperture 540 defining a central axis 545. The raised portion 525 also includes a first end surface 550 distal from the base portion 520 and a second end surface 555 proximal to the base portion 520. The raised portion 525 further includes a threaded aperture 565 defining a central axis 570 and is sized to engage threads 600 of the set screw 510 so that the set screw 510 is rotatable in either a first direction 605 or a second direction 610 (FIG. 12). An anti-backout lock aperture 575 (e.g., a threaded aperture) is formed in the raised portion 525 to define a central axis 578 that is obliquely oriented relative to the central axis 570 of the threaded aperture 565 and the central axis 545 of the connecting aperture 540. An opening 595 is formed at an end of the anti-backout lock aperture 575 to provide communication between the threaded aperture 565 and the anti-backout lock aperture 575. In the illustrated embodiment, an end of the anti-backout lock aperture 575 distal to the opening 595 is positioned closer to the first end surface 550 than the second end surface 555 of the terminal block 505 (e.g., in a direction parallel to the central axis 545 of the connecting aperture 540), but in other embodiments, the end of the anti-backout lock aperture 575 can be positioned closer to the second end surface 555 than the first end surface 550 of the terminal block 505. In further embodiments, the central axis 578 of the anti-backout lock aperture 575 can be parallel to the central axis 545 of the connecting aperture 540 but perpendicular to the central axis 570 of the threaded aperture 565 (similar to the anti-backout lock aperture 175; FIG. 2), or the central axis 578 of the anti-backout lock aperture 575 can be perpendicular to both the central axes 545, 570.

The illustrated anti-backout lock 515 includes a shaft 620 (e.g., a threaded shaft) configured to be engaged by a tool (e.g., an Allen wrench) at one end and has a wedge member 664 having a wedge or abutment surface 640 located at the other end. The illustrated wedge member 664 is made of a material that is softer than the set screw 510 (e.g., rubber, plastic, or the like), and the wedge surface 640 is located at an end of the wedge member 664. In other embodiments, the wedge surface 640 is located on a side of the wedge member 664. In further embodiments, the electrical connector 500 can include more than one anti-backout lock 515, thereby including more than one anti-backout lock aperture 575.

The anti-backout lock 515 is in an unlocked position when the wedge member 664 is spaced away from the opening 595 (e.g., the wedge surface 640 does not extend into the threaded aperture 565). To move the anti-backout lock 515 into a locked position (FIG. 12), the Allen wrench is used to rotate the shaft 620 within the anti-backout lock aperture 575 to move the wedge member 664 toward the opening 595 so that the wedge surface 640 engages the threads 600 of the set screw 510. As a result, the set screw 510 is inhibited from rotating in the first and second directions 605, 610 (e.g., the wedge member 664 is wedged between the set screw 510 and the terminal block 505) to securely maintain the electrical conductor 160 within the electrical connector 500.

Figure 13:
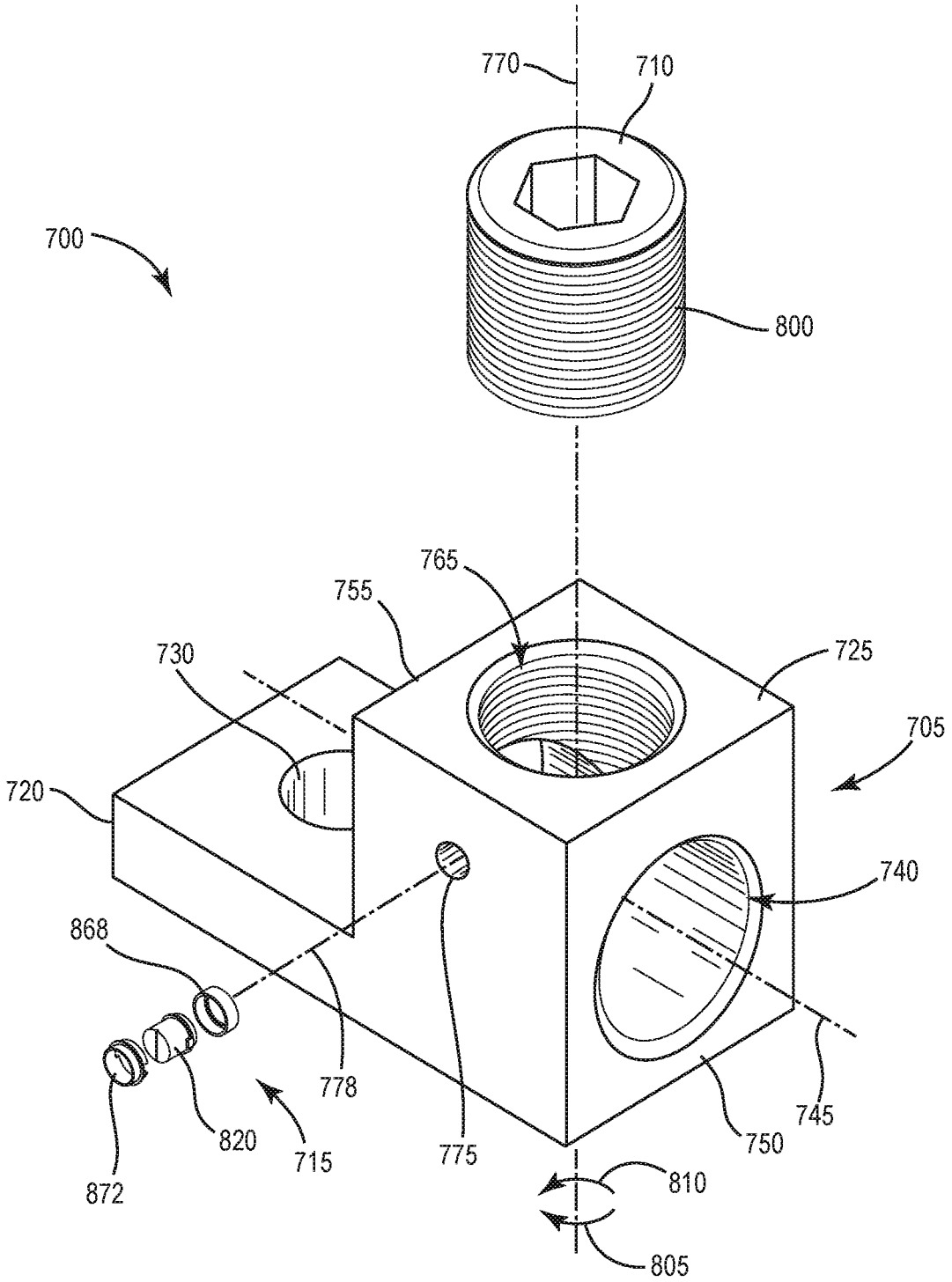
FIG. 13 is an exploded view of an electrical connector including a terminal block, a set screw, and an anti-backout lock according to another embodiment.
Figure 14:
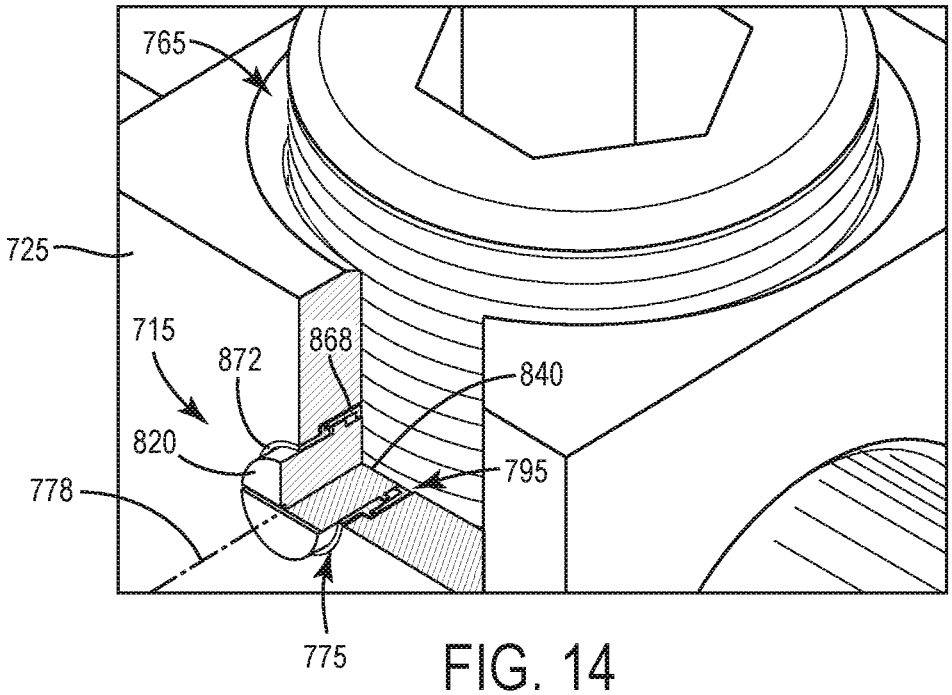
FIG. 14 is a perspective view of the electrical connector of FIG. 13 in an unlocked state allowing movement of the set screw.
Figure 15:
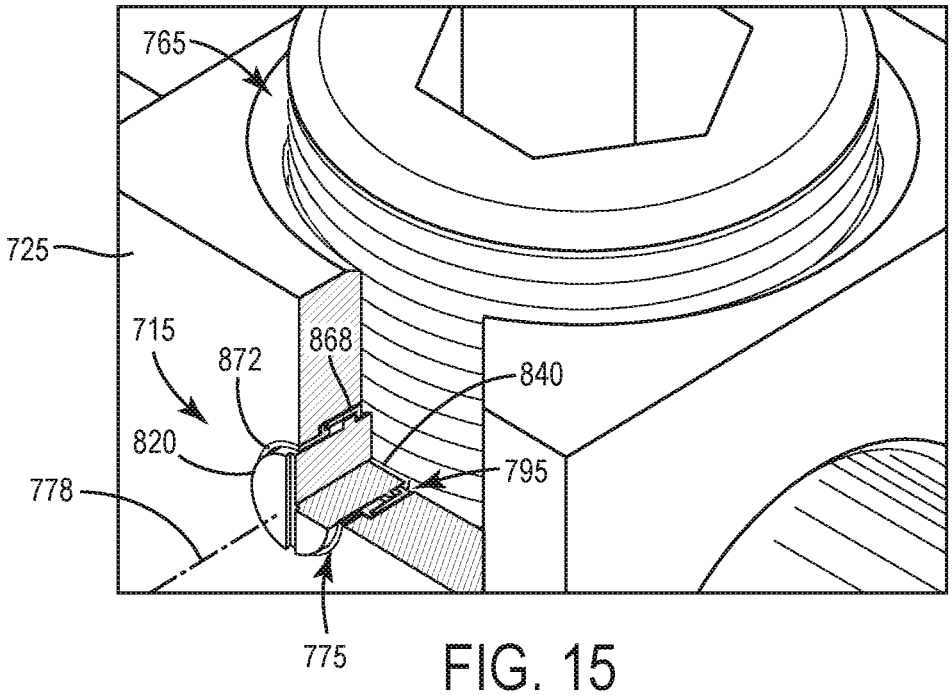
FIG. 15 is a perspective view of the electrical connector of FIG. 13 in a locked state inhibiting movement of the set screw.

FIGS. 13-15 illustrate an electrical connector 700 according to another embodiment. The electrical connector 700 is similar to the electrical connector 100; therefore, similar components are designated with similar reference numbers plus 600, and only the differences between the electrical connectors 100, 700 will be discussed in detail. In addition, components or features described with respect to only one or some of the embodiments described herein are equally applicable to any other embodiments described herein. As such, the electrical connector 700 may have similar components to other embodiments previously described herein with the similar components including similar reference numbers.

FIG. 13 illustrates the electrical connector 700 including a terminal block 705, a set screw 710, and an anti-backout lock 715. The illustrated terminal block 705 includes a base portion 720 having a mounting aperture 730 and a raised portion 725 having a connecting aperture 740 defining a central axis 745. The raised portion 725 includes a first end surface 750 distal from the base portion 720 and a second end surface 755 proximal to the base portion 720. The raised portion 725 also includes a threaded aperture 765 defining a central axis 770 and is sized to engage threads 800 of the set screw 710 so that the set screw 710 is rotatable in either a first direction 805 or a second direction 810. An anti-backout lock aperture 775 is formed within a side of the raised portion 725 to define a central axis 778 that is perpendicular to the central axis 770 of the threaded aperture 765 and the central axis 745 of the connecting aperture 740. In particular, the central axis 778 of the anti-backout lock aperture 775 is intersects the central axis 770 of the threaded aperture 765. An opening 795 (FIGS. 14 and 15) is formed at an end of the anti-backout lock aperture 775 to provide communication between the threaded aperture 765 and the anti-backout lock aperture 775.

The illustrated anti-backout lock 715 includes a shaft or stopper 820 configured to be engaged by a tool (e.g., a flat-head screwdriver, or the like) at one end and has a wedge or abutment surface 840 located at the other end. The illustrated shaft 820 is made of a material that is softer than the set screw 710 (e.g., rubber, plastic, or the like). The anti-backout lock 715 also includes a first bushing member 868 and a second bushing member 872 that are assembled around the shaft 820 in order to support the shaft 820 within the anti-backout lock aperture 775. Specifically, the connection between the shaft 820 and the bushing members 868, 872 allows for the shaft 820 to rotate and translate relative to the bushing members 868, 872 between an unlocked position (FIG. 14) and a locked position (FIG. 15).

In the unlocked position (FIG. 14), the shaft 820 is positioned in a first orientation so that no portion of the wedge surface 840 extends into the threaded aperture 765. As a result, the set screw 710 can be rotated in either direction 805, 810 without the shaft 820 engaging the threads 800 of the set screw 710. In the unlocked position, the electrical conductor 160 can be installed to the electrical connector 700.

In the locked position (FIG. 15), the shaft 820 is rotated by the tool to translate the wedge surface 840 and position the wedge surface 840 within the anti-backout lock aperture 775. In other embodiments, the shaft 820 can include a protrusion extending away from the terminal block 705 to be gripped by an operator to rotate the shaft 820 between the unlocked position and the locked position. In the illustrated embodiment, the shaft 820 is rotated about 90 degrees between the unlocked position and the locked position. In other embodiments, the shaft 820 can be rotated a different amount e.g., 45 degrees, 180 degrees, 270 degrees, etc.) between the unlocked position and the locked position. As a result, the wedge surface 840 engages the threads 800 of the set screw 710 and the set screw 710 is inhibited from rotating in the second direction 810 (e.g., the shaft 820 is wedged between the set screw 710 and the terminal block 705) to securely maintain the electrical conductor 160 within the electrical connector 700.

In other embodiments, the anti-backout lock 715 can be a threaded set screw (e.g., a monolithic brass, steel, etc. threaded set screw). Moreover, the bushing members 868, 872 can be omitted because the threaded set screw threadably engages the anti-backout lock aperture 775. Accordingly, the threaded set screw is rotatable between the unlocked and locked positions by a tool (e.g., Allen wrench, screwdriver, etc.).

Figure 16:
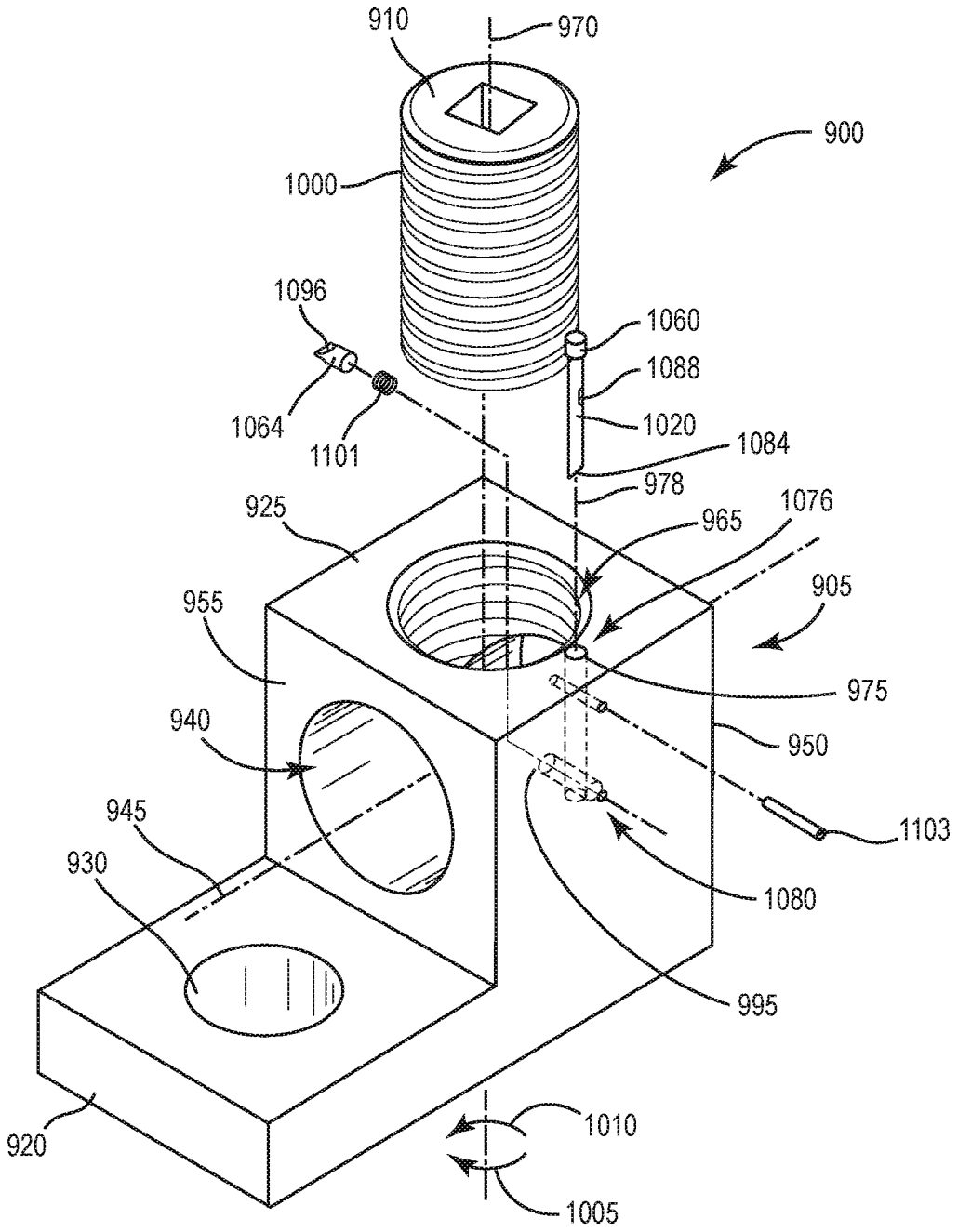
FIG. 16 is an exploded view of an electrical connector including a terminal block, a set screw, and an anti-backout lock according to another embodiment.
Figure 17:
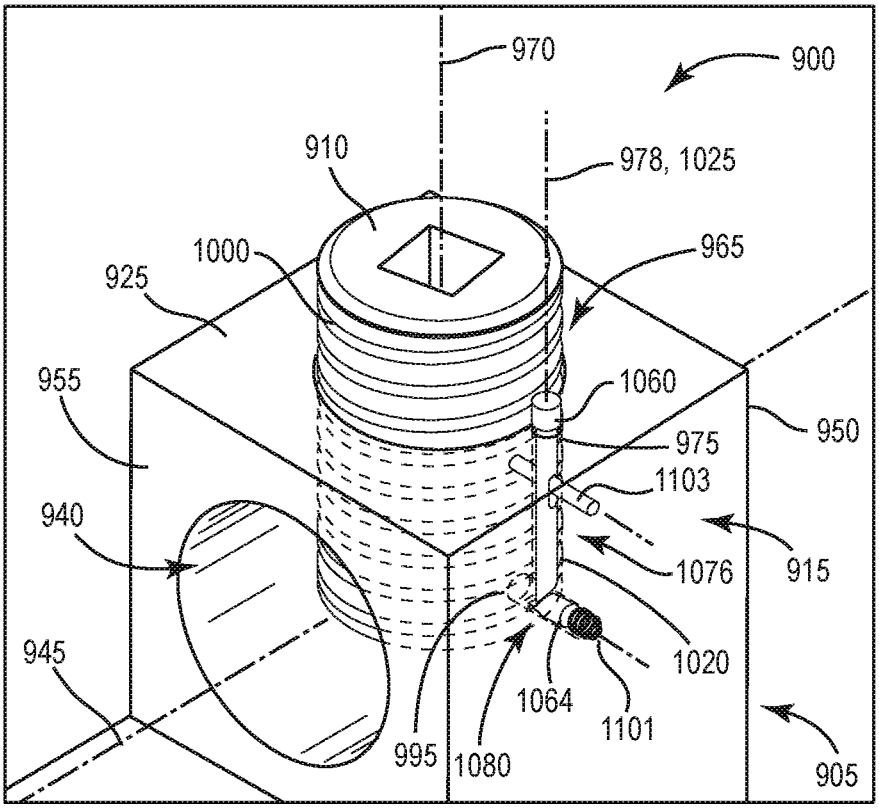
FIG. 17 is a perspective view of the electrical connector of FIG. 16 in an unlocked state allowing movement of the set screw.
Figure 18:
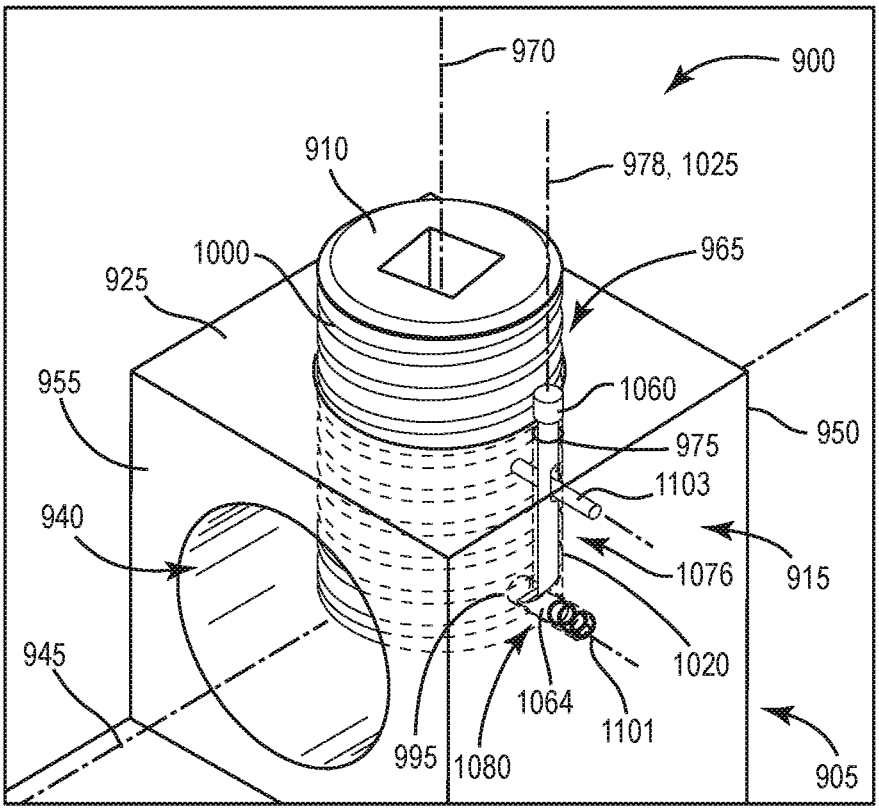
FIG. 18 is a perspective view of the electrical connector of FIG. 16 in a locked state inhibiting movement of the set screw.

FIGS. 16-18 illustrate an electrical connector 900 according to another embodiment. The electrical connector 900 is similar to the electrical connector 100; therefore, similar components are designated with similar reference numbers plus 800, and only the differences between the electrical connectors 100, 900 will be discussed in detail. In addition, components or features described with respect to only one or some of the embodiments described herein are equally applicable to any other embodiments described herein. As such, the electrical connector 900 may have similar components to other embodiments previously described herein with the similar components including similar reference numbers.

FIG. 16 illustrates the electrical connector 900 including a terminal block 905, a set screw 910, and an anti-backout lock 915. The illustrated terminal block 905 includes a base portion 920 having a mounting aperture 930 and a raised portion 925 having a connecting aperture 940 defining a central axis 945. The raised portion 925 includes a first end surface 950 distal from the base portion 920 and a second end surface 955 proximal to the base portion 920. The raised portion 925 also includes a threaded aperture 965 defining a central axis 970 and is sized to engage threads 1000 of the set screw 910 so that the set screw 910 is rotatable in either a first direction 1005 or a second direction 1010. The raised portion 925 further includes an anti-backout lock aperture 975 having a first portion 1076 (FIGS. 17 and 18) defining a central axis 978 that is perpendicular to the central axis 945 of the connecting aperture 940 but parallel to the central axis 970 of the threaded aperture 965. The anti-backout lock aperture 975 also includes a second portion 1080 (FIGS. 17 and 18) oriented perpendicular to the first portion 1076 (e.g., the second portion 1080 is perpendicular to the central axis 945 of the connecting aperture 940 and the central axis 970 of the threaded aperture 965). An opening 995 is formed at an end of the second portion 1080 of the anti-backout lock aperture 975 to provide communication between the threaded aperture 965 and the anti-backout lock aperture 975. In the illustrated embodiment, the second portion 1080 is a through hole extending between the threaded aperture 965 and a side of the terminal block 905, but in other embodiments, the second portion 1080 can be closed at one end, thereby only opening into the threaded aperture 965.

The illustrated anti-backout lock 915 includes a shaft 1020 defining a longitudinal axis 1025 and having an actuator 1060 at one end of the shaft 1020 and a first angled surface 1084 obliquely oriented relative to the longitudinal axis 1025 at the other end of the shaft 1020. The shaft 1020 also includes a slot 1088 positioned between the actuator 1060 and the angled surface 1084. The illustrated anti-backout lock 915 also includes a duckbill shaped wedge member 1064 having a protrusion 1092 with a wedge surface 1040, a second angled surface 1096, a biasing member 1101 (e.g., a coil spring), and a pin 1103.

To assemble the anti-backout lock 915 to the terminal block 905, the shaft 1020 is inserted into the first portion 1076 of the anti-backout lock aperture 975 and the pin 1103 is inserted through a side of the terminal block 905 to be received through the slot 1088. The pin 1103 inhibits the shaft 1020 from moving out of the anti-backout lock aperture 975. The wedge member 1064 is inserted into the second portion 1080 of the anti-backout lock 915 so that the protrusion 1092 faces the opening 995 and the second angled surface 1096 faces the first angled surface 1084 of the shaft 1020. The biasing member 1101 is fixed within the second portion 1080 so that the biasing member 1101 biases the wedge member 1064 toward the threaded aperture 965. Moreover, the wedge member 1064 is inhibited from being biased completely out of the second portion 1080 of the anti-backout lock aperture 975 and into the threaded aperture 965 by the first angled surface 1084 being engaged with the second angled surface 1096. In other words, the shaft 1020 and the biasing member 1101 maintains the wedge member 1064 within the second portion 1080.

In an unlocked position of the anti-backout lock 915 (FIG. 17), the actuator 1060 is depressed toward the terminal block 905 so that the first angled surface 1084 slidably engages the second angled surface 1096 to move the wedge member 1064 against the biasing force of the biasing member 1101 (e.g., the wedge member 1064 moves away from the threaded aperture 965). As a result, no portion of the wedge surface 1040 extends into the threaded aperture 965. The set screw 910 can then be rotated in either direction 1005, 1010 without the wedge member 1064 engaging the threads 1000 of the set screw 910. In the unlocked position, the electrical conductor 160 can be installed to the electrical connector 900.

In a locked position of the anti-backout lock 915 (FIG. 18), the actuator 1060 is released allowing the biasing member 1101 to move the wedge member 1064 toward the set screw 910. At the same time, the shaft 1020 moves upwardly away from the wedge member 1064 as the first angled surface 1084 slides upwardly along the second angled surface 1096. As a result, the wedge surface 1040 engages the threads 1000 of the set screw 910 with the biasing force of the biasing member 1101 and the set screw 910 is inhibited from rotating in the first and second directions 1005, 1010 (e.g., the wedge member 1064 is wedged between the set screw 910 and the terminal block 905 by the biasing member 1101) to securely maintain the electrical conductor 160 within the electrical connector 900.

Figure 19:
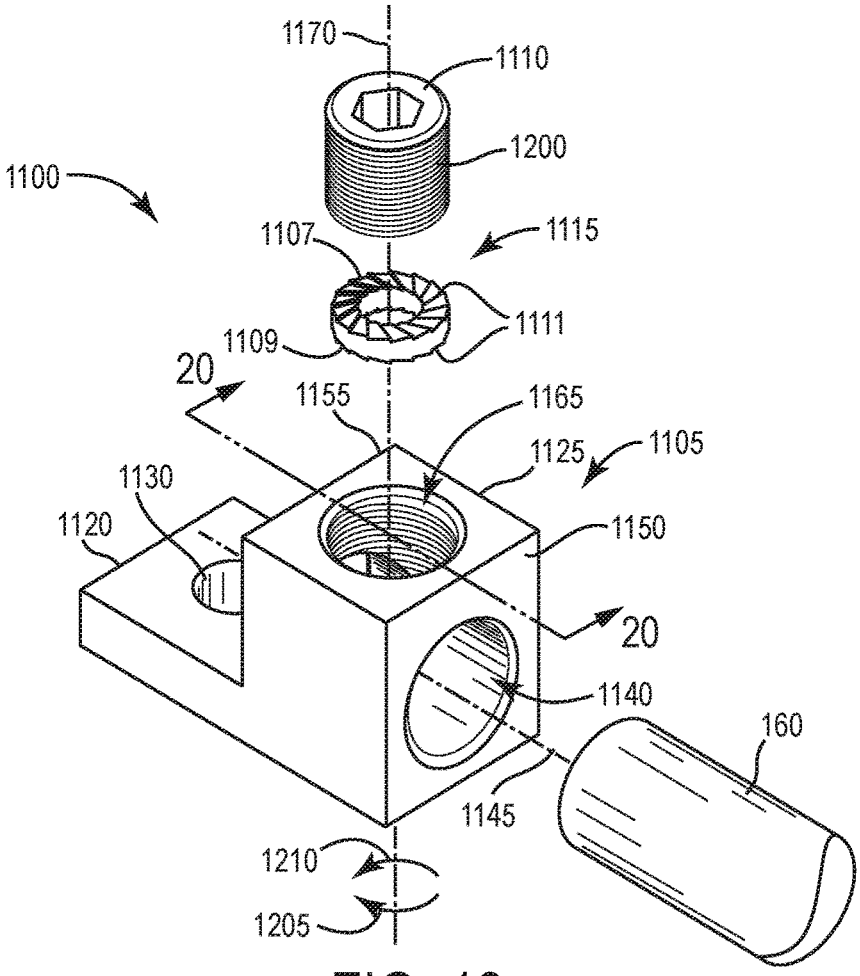
FIG. 19 is an exploded view of an electrical connector including a terminal block, a set screw, and an anti-backout lock according to another embodiment.
Figure 20:
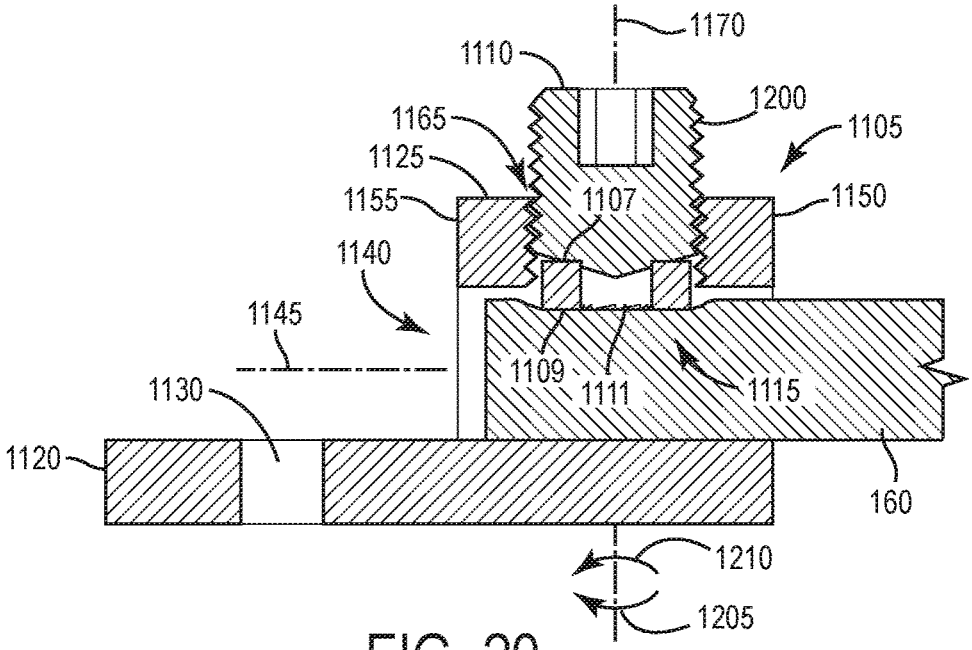
FIG. 20 is a cross sectional view of the electrical connector of FIG. 19 viewed along section 20-20 illustrating the electrical connector in a locked state inhibiting movement of the set screw.

FIGS. 19 and 20 illustrate an electrical connector 1100 according to another embodiment. The electrical connector 1100 is similar to the electrical connector 100; therefore, similar components are designated with similar reference numbers plus 1000, and only the differences between the electrical connectors 100, 1100 will be discussed in detail. In addition, components or features described with respect to only one or some of the embodiments described herein are equally applicable to any other embodiments described herein. As such, the electrical connector 1100 may have similar components to other embodiments previously described herein with the similar components including similar reference numbers.

FIG. 19 illustrates the electrical connector 1100 including a terminal block 1105, a set screw 1110, and an anti-backout lock 1115. The illustrated terminal block 1105 includes a base portion 1120 having a mounting aperture 1130 and a raised portion 1125 having a connecting aperture 1140 defining a central axis 1145. The raised portion 1125 includes a first end surface 1150 distal from the base portion 1120 and a second end surface 1155 proximal to the base portion 1120. The raised portion 1125 also includes a threaded aperture 1165 defining a central axis 1170 and is sized to engage threads 1200 of the set screw 1110 so that the set screw 1110 is rotatable in either a first direction 1205 or a second direction 1210.

The illustrated anti-backout lock 1115 is a serrated washer (e.g., a cylindrical ring) including upper and lower sides 1107, 1109 having teeth 1111. In one embodiment, the teeth 1111 can be formed only on one side 1107, 1109 of the serrated washer 1115 and/or the serrated washer 1115 can be a solid cylindrical disk. In other embodiments, an outer circumferential surface of the serrated washer 1115 can include threads that threadably engage the threads 1200 of the threaded aperture 1165. In further embodiments, the diameter of the serrated washer 1115 can be smaller than a diameter of the threaded aperture 1165 so that the serrated washer 1115 can be dropped into the threaded aperture 1165 without engaging the threads 1200. In yet further embodiments, the serrated washer 1115 is made of material that is harder than the set screw 1110.

To assemble the electrical connector 1100, the electrical conductor 160 is inserted into the connecting aperture 1140 at the desired depth (e.g., the electrical conductor 160 abuts the base portion 1120), the anti-backout lock 1115 is received within the threaded aperture 1165 so that the lower side 1109 faces the electrical conductor 160, and the set screw 1110 is threaded to the threaded aperture 1165. As such, the upper side 1107 of the anti-backout lock 1115 faces the set screw 1110.

In a locked position of the anti-backout lock 1115 (FIG. 20), the set screw 1110 is rotated in the first direction 1205 to push and wedge the anti-backout lock 1115 into the electrical conductor 160. Because the anti-backout lock 1115 is harder than the set screw 1110, as well as the electrical conductor 160, the set screw 1110 and the electrical conductor 160 deform with impressions of the teeth 1111 as the anti-backout lock 1115 is sandwiched therebetween. The teeth 1111 are arranged to inhibit the set screw 1110 from rotating in the second direction 1210 (e.g., the anti-backout lock 1115 is wedged between the set screw 1110 and the set screw 1110) to securely maintain the electrical conductor 160 within the electrical connector 1100. In particular, the teeth 1111 formed on the upper side 1107 of the anti-backout lock 1115 are angled toward the second direction 1210 to inhibit movement of the set screw 1110 in the second direction 1210. In one embodiment, the teeth 1111 formed on the lower side 1109 can be angled toward the first direction 1205 or toward the second direction 1210.

However, to release the electrical conductor 160 from the electrical connector 1100, the set screw 1110 is rotated in the second direction 1210 by a tool (e.g., Allen wrench) against the anti-rotational force provided by the anti-backout lock 1115. As such, the set screw 1110 is rotated out of the threaded aperture 1165 and the wedge force acting on the electrical conductor 160 by the anti-backout lock 1115 is eliminated. In some embodiments, another tool (e.g., a flat head screwdriver, pliers, etc.) is used to pry the anti-backout lock 1115 from the electrical conductor 160 when the anti-backout lock 1115 is depressed into the electrical conductor 160.

Figure 21:
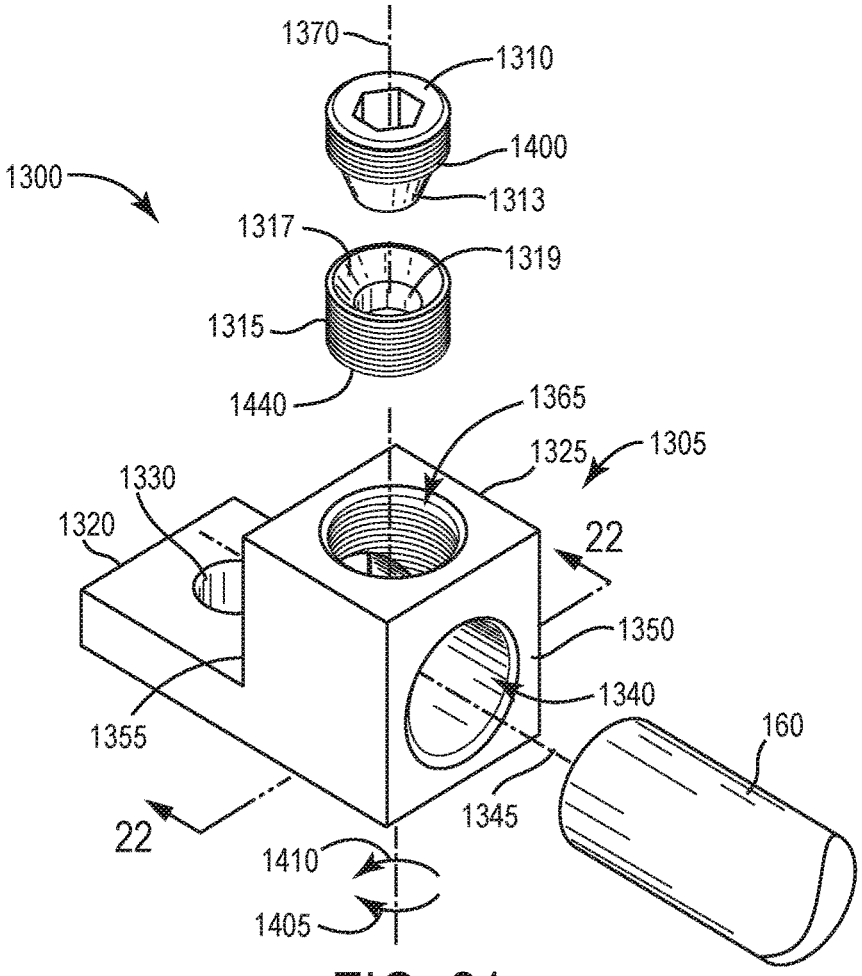
FIG. 21 is an exploded view of an electrical connector including a terminal block, a set screw, and an anti-backout lock according to another embodiment.
Figure 22:
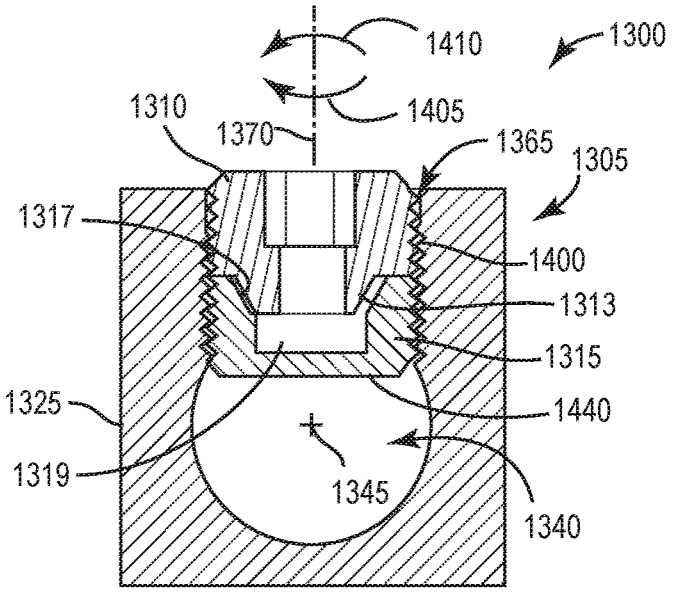
FIG. 22 is a cross sectional view of the electrical connector of FIG. 21 viewed along section 22-22 illustrating the electrical connector in a locked state inhibiting movement of the set screw.

FIGS. 21 and 22 illustrate an electrical connector 1300 according to another embodiment. The electrical connector 1300 is similar to the electrical connector 100; therefore, similar components are designated with similar reference numbers plus 1200, and only the differences between the electrical connectors 100, 1300 will be discussed in detail. In addition, components or features described with respect to only one or some of the embodiments described herein are equally applicable to any other embodiments described herein. As such, the electrical connector 1300 may have similar components to other embodiments previously described herein with the similar components including similar reference numbers.

FIG. 21 illustrates the electrical connector 1300 including a terminal block 1305, a set screw 1310, and an anti-backout lock 1315. The illustrated terminal block 1305 includes a base portion 1320 having a mounting aperture 1330 and a raised portion 1325 having a connecting aperture 1340 defining a central axis 1345. The raised portion 1325 includes a first end surface 1350 distal from the base portion 1320 and a second end surface 1355 proximal to the base portion 1320. The raised portion 1325 also includes a threaded aperture 1365 defining a central axis 1370 and is sized to engage threads 1400 of the set screw 1310 so that the set screw 1310 is rotatable in either a first direction 1405 or a second direction 1410. The illustrated set screw 1310 includes an eccentric protrusion 1313 extending from a bottom surface of the set screw 1310. In the illustrated embodiment, the eccentric protrusion 1313 is tapered with the smaller dimension positioned away from the bottom surface of the set screw 1310.

The illustrated anti-backout lock 1315 is similar to the set screw 1310 and includes a tapered inner surface 1317 surrounding a drive portion 1319 positioned distal to a bottom wedge surface 1440. The drive portion 1319 is sized to receive a tool (e.g., Allen wrench, Phillips screwdriver, flat head screwdriver, etc.). In other embodiments, the anti-backout lock 1315 can include the eccentric protrusion 1313 and the set screw 1310 can include the tapered inner surface 1317, the drive portion 1319, and the bottom wedge surface 1440. As such, the anti-backout lock 1315 would be positioned above the set screw 1310.

To assemble the electrical connector 1300, the electrical conductor 160 is inserted into the connecting aperture 1340 at the desired depth and the anti-backout lock 1315 is threadably received within the threaded aperture 1365 by the tool engaging the drive portion 1319 and rotating the anti-backout lock 1315 in the first direction 1405. As such, the wedge surface 1440 contacts the electrical conductor 160 and the anti-backout lock 1315 is tightened to press the anti-backout lock 1315 into the electrical conductor 160. Thereafter, the set screw 1310 is threaded into the threaded aperture 1365 so that the eccentric protrusion 1313 is received within the tapered inner surface 1317 of the anti-backout lock 1315. The eccentric protrusion 1313 is arranged on the set screw 1310 so that a central axis of the eccentric protrusion 1313 is misaligned with the central axis 1370 of the threaded aperture 1365 once the set screw 1310 is received within the threaded aperture 1365. Accordingly, as the set screw 1310 is tightened against the anti-backout lock 1315 toward the electrical conductor 160, the eccentric protrusion 1313 pushes and wedges the anti-backout lock 1315 against the threaded aperture 1365 to position the anti-backout lock 1315 in a locked position (FIG. 22).

However, to release the electrical conductor 160 from the electrical connector 1300, the set screw 1310 is rotated in the second direction 1410 by a tool to remove the set screw 1310 from the terminal block 1305. Once the eccentric protrusion 1313 disengages from the inner tapered surface 1317 of the anti-backout lock 1315, the wedge forces acting on the anti-backout lock 1315 from the set screw 1310 are eliminated and a tool can reengage the drive portion 1319 to rotate the anti-backout lock 1315 away from the electrical conductor 160.

Figure 23:
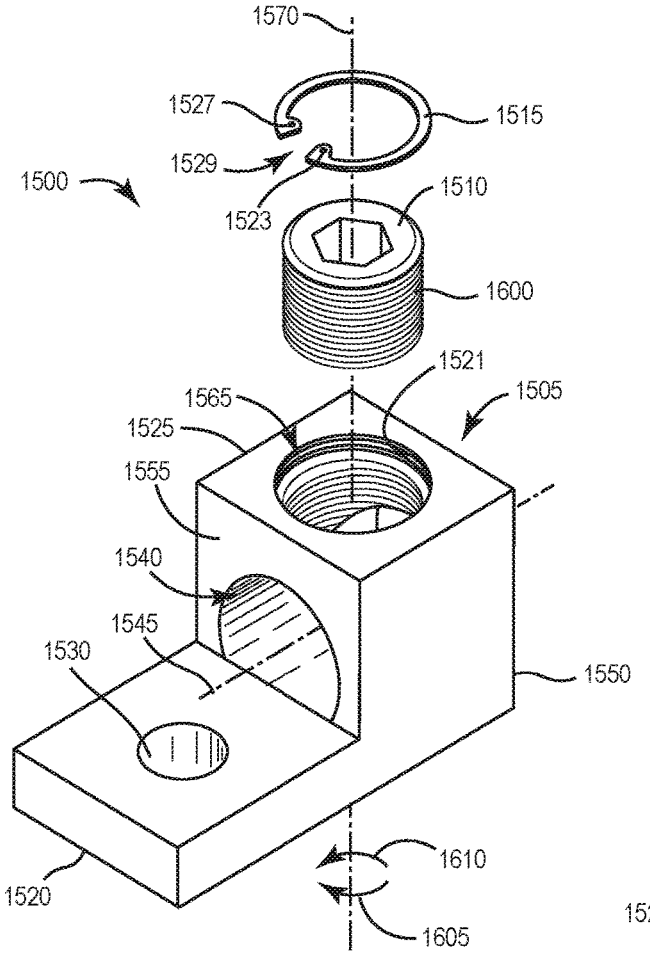
FIG. 23 is an exploded view of an electrical connector including a terminal block, a set screw, and an anti-backout lock according to another embodiment.
Figure 24:
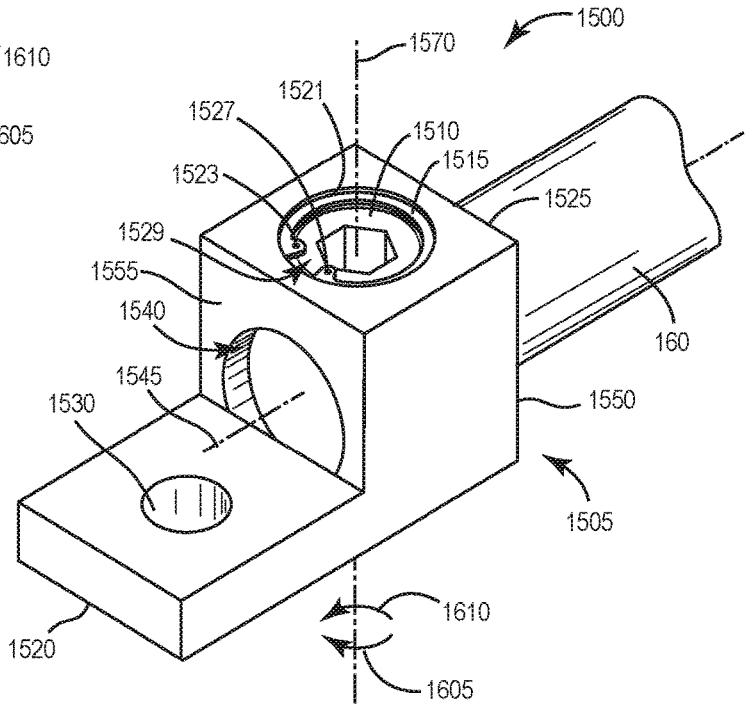
FIG. 24 is a perspective view of the electrical connector of FIG. 23 in a locked state inhibiting movement of the set screw.

FIGS. 23 and 24 illustrate an electrical connector 1500 according to another embodiment. The electrical connector 1500 is similar to the electrical connector 100; therefore, similar components are designated with similar reference numbers plus 1400, and only the differences between the electrical connectors 100, 1500 will be discussed in detail. In addition, components or features described with respect to only one or some of the embodiments described herein are equally applicable to any other embodiments described herein. As such, the electrical connector 1500 may have similar components to other embodiments previously described herein with the similar components including similar reference numbers.

FIG. 23 illustrates the electrical connector 1500 including a terminal block 1505, a set screw 1510, and an anti-backout lock 1515. The illustrated terminal block 1505 includes a base portion 1520 having a mounting aperture 1530 and a raised portion 1525 having a connecting aperture 1540 defining a central axis 1545. The raised portion 1525 includes a first end surface 1550 distal from the base portion 1520 and a second end surface 1555 proximal to the base portion 1520. The raised portion 1525 also includes a threaded aperture 1565 defining a central axis 1570 and is sized to engage threads 1600 of the set screw 1510 so that the set screw 1510 is rotatable in either a first direction 1605 or a second direction 1610. The raised portion 1525 further includes a circumferential channel 1521 located at an end of the threaded aperture 1565 distal to the connecting aperture 1540 and surrounds the threaded aperture 1565.

The illustrated anti-backout lock 1515 is a resilient C-clip including a first aperture 1523 located adjacent a first end of the C-clip 1515 and a second aperture 1527 located adjacent a second end of the C-clip 1515 with a gap 1529 positioned between the first and second apertures 1523, 1527. The first and second apertures 1523, 1527 are sized to receive prongs of a tool (e.g., a retaining ring pliers, etc.) and with actuation of the tool, a profile (e.g., diameter) of the C-clip 1515 is reduced. In other words, the tool moves the ends of the C-clip 1515 toward each other to reduce the profile of the C-clip 1515. Once the tool is removed from the C-clip 1515, the C-clip 1515 resiliently expands back to its original profile (e.g., diameter).

To assemble the electrical connector 1500, the electrical conductor 160 is inserted into the connecting aperture 1540 at the desired depth, and the set screw 1510 is threaded into the threaded aperture 1565 to abut the electrical conductor 160. In particular, the set screw 1510 is received within the threaded aperture 1565 at least until a top surface of the set screw 1510 is below the channel 1521 (FIG. 24). Thereafter, the anti-backout lock 1515 is gripped by the retaining ring pliers to reduce the profile of the anti-backout lock 1515 to be smaller than an inner diameter of the channel 1521 so that the anti-backout lock 1515 can be received within the channel 1521. The retaining ring pliers then releases the anti-backout lock 1515 so that the anti-backout lock 1515 can fully expand into the channel 1521 to be positioned in a locked position (FIG. 24) to inhibit rotation of the set screw 1510 in the second direction 1610.

However, to release the electrical conductor 160 from the electrical connector 1500, the retaining ring pliers reengages and reduces the profile of the anti-backout lock 1515 (e.g., moves the first and second apertures 1523, 1527 together to decrease the gap 1529) to remove the anti-backout lock 1515 from the channel 1521. Thereafter, the set screw 1510 can be removed from the terminal block 1505, and the electrical conductor 160 can be removed from the electrical connector 1500.

Figure 25:
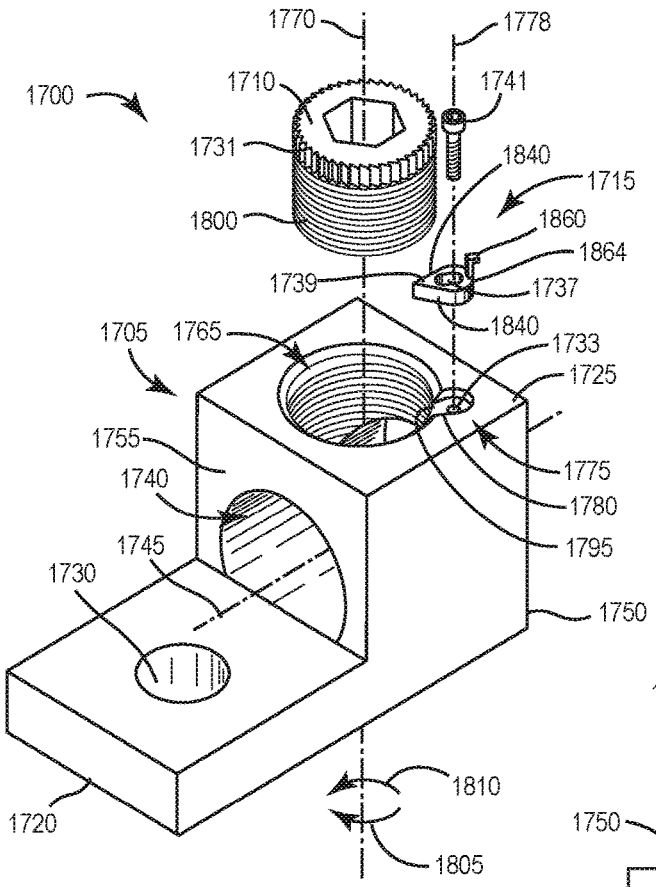
FIG. 25 is an exploded view of an electrical connector including a terminal block, a set screw, and an anti-backout lock according to another embodiment.
Figure 26:
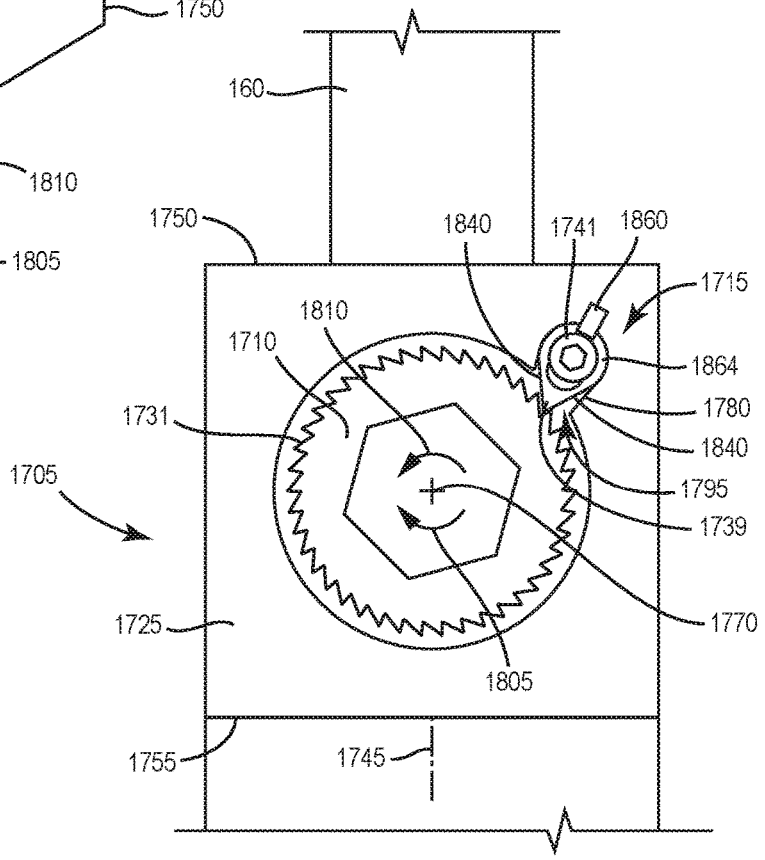
FIG. 26 is a perspective view of the electrical connector of FIG. 25 in a locked state inhibiting movement of the set screw.

FIGS. 25 and 26 illustrate an electrical connector 1700 according to another embodiment. The electrical connector 1700 is similar to the electrical connector 100; therefore, similar components are designated with similar reference numbers plus 1600, and only the differences between the electrical connectors 100, 1700 will be discussed in detail. In addition, components or features described with respect to only one or some of the embodiments described herein are equally applicable to any other embodiments described herein. As such, the electrical connector 1700 may have similar components to other embodiments previously described herein with the similar components including similar reference numbers.

FIG. 25 illustrates the electrical connector 1700 including a terminal block 1705, a set screw 1710, and an anti-backout lock 1715. The set screw 1710 also includes teeth or serrations 1731 formed around a circumferential surface of the set screw 1710 adjacent a top surface of the set screw 1710 and are angled in the same direction as the second direction 1810. In the illustrated embodiment, the teeth 1731 define an outer diameter of the set screw 1710 that is less than an outer diameter of the threads 1800. In other embodiments, the teeth 1731 can define an outer diameter of the set screw 1710 that is equal to or greater than an outer diameter of the threads 1800. The illustrated terminal block 1705 includes a base portion 1720 having a mounting aperture 1730 and a raised portion 1725 having a connecting aperture 1740 defining a central axis 1745. The raised portion 1725 includes a first end surface 1750 distal from the base portion 1720 and a second end surface 1755 proximal to the base portion 1720. The raised portion 1725 also includes a threaded aperture 1765 defining a central axis 1770 and is sized to engage threads 1800 of the set screw 1710 so that the set screw 1710 is rotatable in either a first direction 1805 or a second direction 1810. The raised portion 1725 further includes an anti-backout lock aperture 1775 defining a central axis 1778 oriented substantially parallel to the central axis 1770 of the threaded aperture 1765 and substantially perpendicular to the central axis 1745 of the connecting aperture 1740. The anti-backout lock aperture 1775 includes a treaded portion 1733 and a counter-bore portion 1780 having an opening 1795 formed in a side surface of the counter-bore portion 1780 that is in communication with the threaded aperture 1765.

The illustrated anti-backout lock 1715 includes a tear-drop-shaped wedge member 1864 having an opening 1737, an actuator 1860 extending away from an upper surface of the wedge member 1864, and a protrusion 1739 opposite the actuator 1860 having opposing wedge surfaces 1840. The wedge member 1864 is received within the counter-bore portion 1780 of the anti-backout lock aperture 1775 so that a fastener 1741 can be received through the opening 1737 and threadably engage the threaded portion 1733. The actuator 1860 extends beyond a top surface of the raised portion 1725 for the operator to engage and move the actuator 1860 about the fastener 1739 in either direction, which ultimately moves the protrusion 1739 in the same direction.

To assemble the remaining components of the electrical connector 1700, the electrical conductor 160 is inserted into the connecting aperture 1740 at the desired depth, and the protrusion 1739 is moved, for example, by the actuator 1860 into the counter-bore portion 1780 as to not interfere with the set screw 1710 being received into the threaded aperture 1765. The set screw 1710 is further rotated into the threaded aperture 1765 to abut the electrical conductor 160 and to align the teeth 1731 of the set screw 1710 with the opening 1795 of the anti-backout lock aperture 1775. Thereafter, the wedge member 1864 is rotated into the set screw 1710 for the protrusion 1739 to be received between adjacent teeth 1731. Once the protrusion 1739 is received between adjacent teeth 1731, the anti-backout lock 1715 is in a locked position (FIG. 26) and the set screw 1710 is inhibited from moving in the second direction 1810. In particular, one wedge surface 1840 engages one tooth 1731 and the other wedge surface 1840 engages a surface of the counter-bore portion 1780 to wedge the wedge member 1864 between the set screw 1710 and the terminal block 1705 to inhibit movement of the set screw 1710 in the second direction 1810. However, the set screw 1710 can move in the first direction 1805 when the anti-backout lock 1715 is in the locked position. As such, the anti-backout lock 1715 and the set screw 1710 function similar to a ratchet and pawl assembly with the wedge member 1864 acting similar to a pawl and the teeth 1731 acting similar to a ratchet gear. In one embodiment, the height of the teeth 1731 and/or the depth of the counter-bore portion 1780 can be dependent upon a thickness of one electrical conductor 160 or a range of thicknesses of electrical conductors 160 received within the connecting aperture 1740. In other embodiments, the wedge member 1864 can be fixed from moving relative to the terminal block 1705 by tightening the fastener 1741 against the wedge member 1864. In further embodiments, the wedge member 1864 can be biased into the set screw 1710 by a biasing member (e.g., a spring).

To release the electrical conductor 160 from the electrical connector 1700, the set screw 1710 is rotated slightly in the first direction 1805 to allow enough clearance between the protrusion 1739 and the teeth 1731 for the wedge member 1864 to be rotated by the actuator 1860 away from and out of engagement with the set screw 1710. Thereafter, the set screw 1710 can move in the second direction 1810 to be removed from the terminal block 1705, and the electrical conductor 160 can be removed from the electrical connector 1700.

Figure 27:
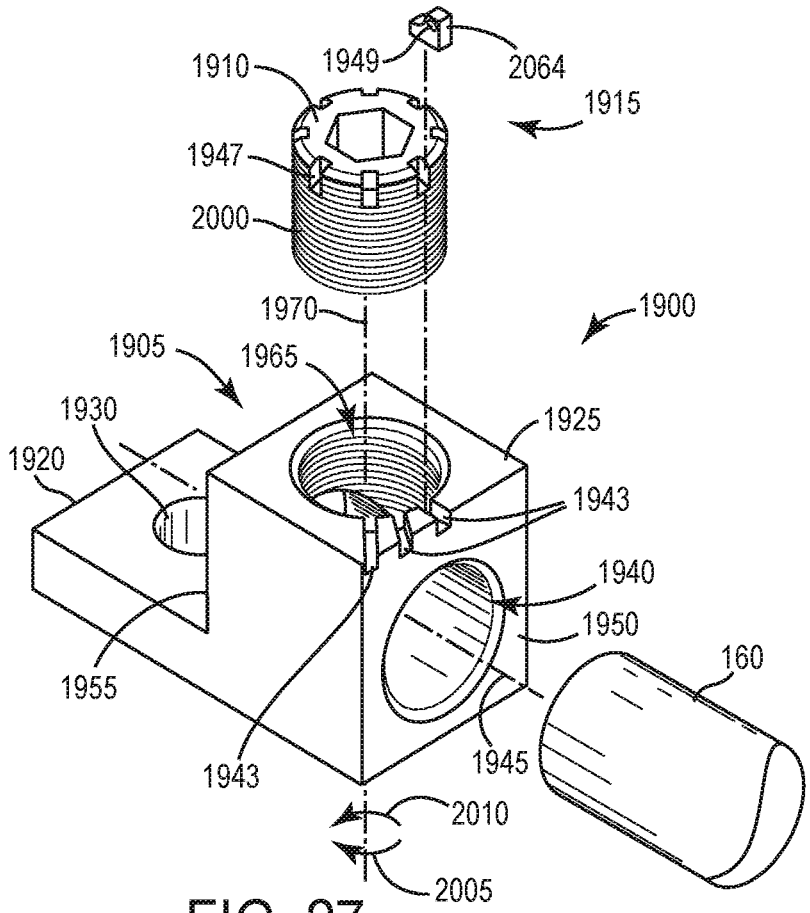
FIG. 27 is an exploded view of an electrical connector including a terminal block, a set screw, and an anti-backout lock according to another embodiment.
Figure 28:
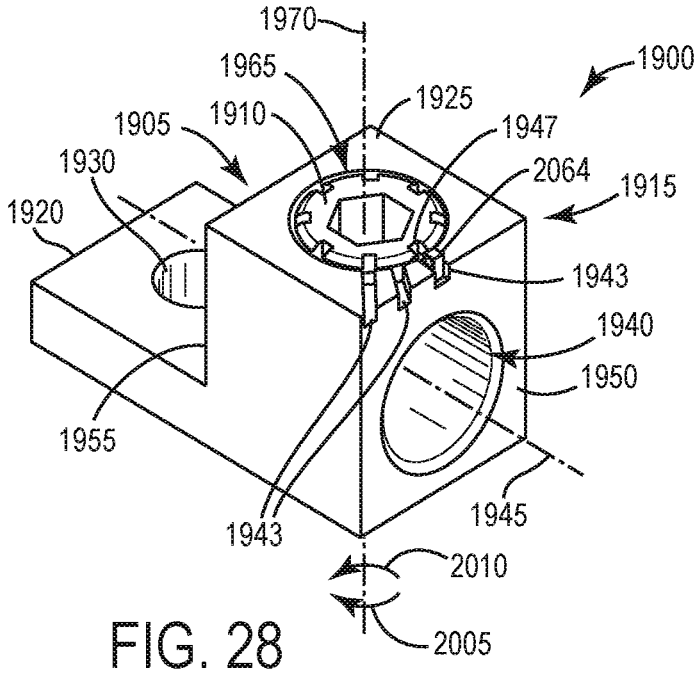
FIG. 28 is a perspective view of the electrical connector of FIG. 27 in a locked state inhibiting movement of the set screw.

FIGS. 27 and 28 illustrate an electrical connector 1900 according to another embodiment. The electrical connector 1900 is similar to the electrical connector 100; therefore, similar components are designated with similar reference numbers plus 1800, and only the differences between the electrical connectors 100, 1900 will be discussed in detail. In addition, components or features described with respect to only one or some of the embodiments described herein are equally applicable to any other embodiments described herein. As such, the electrical connector 1900 may have similar components to other embodiments previously described herein with the similar components including similar reference numbers.

FIG. 27 illustrates the electrical connector 1900 including a terminal block 1905, a set screw 1910, and an anti-backout lock 1915. The illustrated terminal block 1905 includes a base portion 1920 having a mounting aperture 1930 and a raised portion 1925 having a connecting aperture 1940 defining a central axis 1945. The raised portion 1925 includes a first end surface 1950 distal from the base portion 1920 and a second end surface 1955 proximal to the base portion 1920. The raised portion 1925 also includes a threaded aperture 1965 defining a central axis 1970 and is sized to engage threads 2000 of the set screw 1910 so that the set screw 1910 is rotatable in either a first direction 2005 or a second direction 2010. The illustrated raised portion 1925 also includes a plurality of channels 1943 located on a top surface of the raised portion 1925 and oriented radially relative to the central axis 1970 of the threaded aperture 1965 so that an end of each channel 1943 is in communication with the threaded aperture 1965. In the illustrated embodiment, the plurality of channels 1943 includes three channels oriented about 22.5 degrees relative to each other, and each channel 1943 extends from the threaded aperture 1965 to the first end surface 1950 of the raised portion 1925. In other embodiments, the plurality of channels 1943 can include more or less than three channels, adjacent channels 1943 can be spaced from each other by an angle greater than or less than 22.5 degrees, and/or the channels 1943 may not completely extend to the first end surface 1950. In further embodiments, the channels 1943 can be positioned at different locations on the top surface of the raised portion 1925.

In addition, the illustrated set screw 1910 also includes a plurality of slots 1947 extending into side and upper surfaces of the set screw 1910. In particular, the slots 1947 partially extend along the side surface of the set screw 1910. In other embodiments, the slots 1947 can completely extend from a top surface of the set screw 1910 to a bottom surface of the set screw 1910. In the illustrated embodiment, the plurality of slots 1947 includes eight slots, but in other embodiments, the plurality of slots 1947 can include more or less than eight slots.

The illustrated anti-backout lock 1915 includes a wedge member 2064 (e.g., a planar bar of material) having an aperture 1949.

To assemble the electrical connector 1900, the electrical conductor 160 is inserted into the connecting aperture 1940 at the desired depth, and the set screw 1910 is rotated into the threaded aperture 1965 to abut the electrical conductor 160 until bottom surfaces of the slots 1947 are positioned at the same height or below the channels 1943. Thereafter, one of the slots 1947 can be radially aligned with one of the channels 1943 so that the anti-backout lock 1915 can be received into both the slot 1947 and the channel 1943 for the anti-backout lock 1915 to be positioned in a locked position (FIG. 28). As such, the anti-backout lock 1915 is wedged between the terminal block 1905 and the set screw 1910 to inhibit the set screw 1910 from rotating in the second direction 2010. In the illustrated embodiment, the channels 1943 include three channels to more easily align one of the channels 1943 with one of the slots 1947 without over tightening the set screw 1910.

To release the electrical conductor 160 from the electrical connector 1900, the backout lock 1915 is removed from the slot 1947 and the channel 1943. In particular, the wedge member 2064 is sized so that the aperture 1949 is accessible (e.g., positioned out of the slot 1947 and the channel 1943) for a tool (e.g., a pin, pliers, etc.) to be inserted into the aperture 1949 to remove the wedge member 2064. In other embodiments, the aperture 1949 can be omitted and the wedge member 2064 can be gripped and removed by a tool (e.g., pliers, etc.). Thereafter, the set screw 1910 can be rotated in the second direction 2010 and removed from the terminal block 1905.

Figure 29:
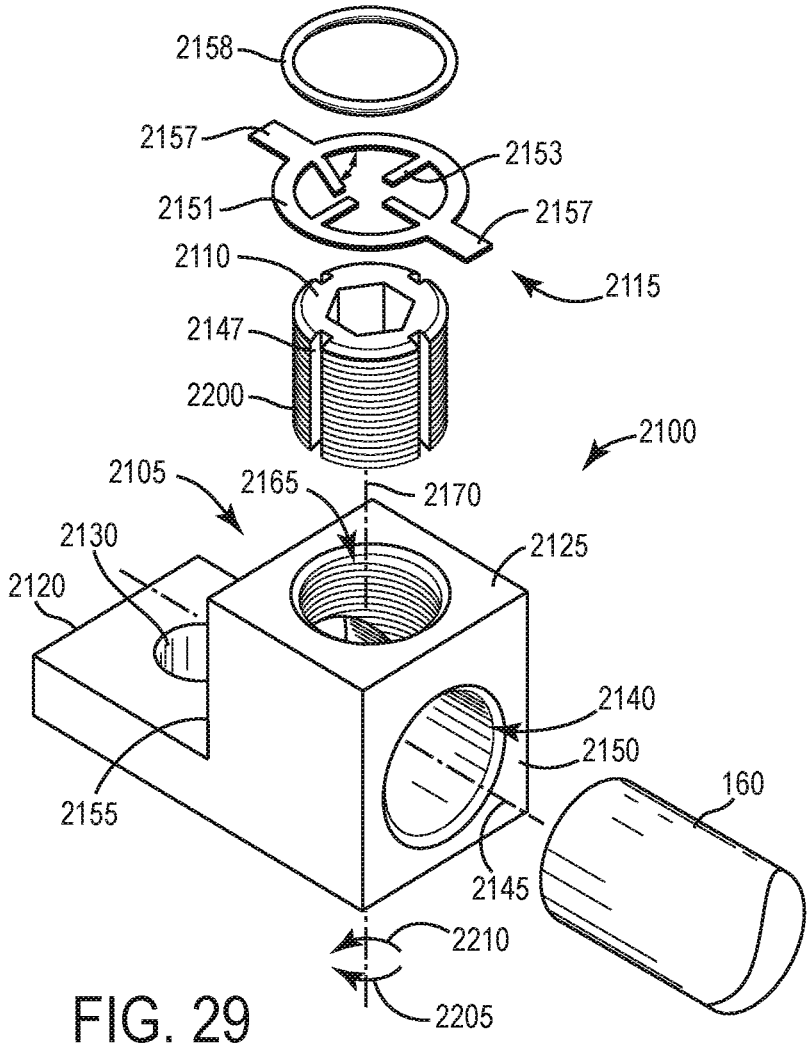
FIG. 29 is an exploded view of an electrical connector including a terminal block, a set screw, and an anti-backout lock according to another embodiment.
Figure 30:
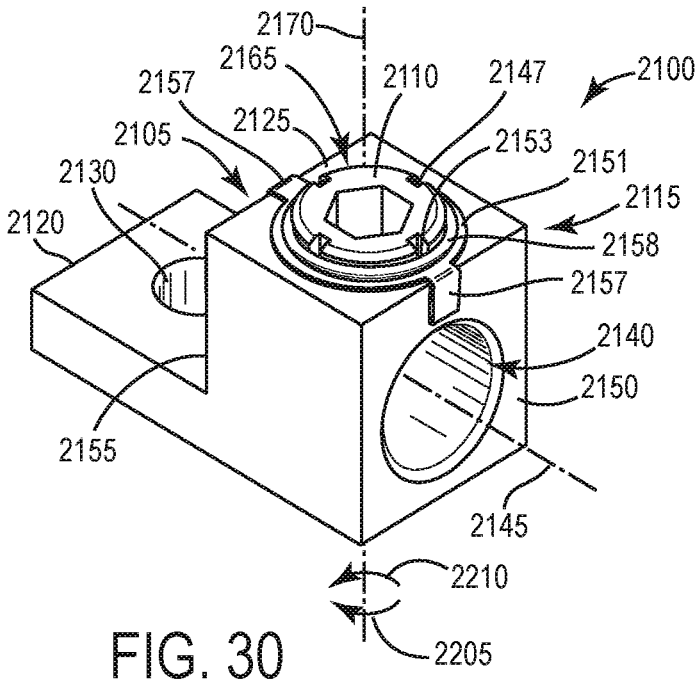
FIG. 30 is a perspective view of the electrical connector of FIG. 29 in a locked state inhibiting movement of the set screw.

FIGS. 29 and 30 illustrate an electrical connector 2100 according to another embodiment. The electrical connector 2100 is similar to the electrical connector 100; therefore, similar components are designated with similar reference numbers plus 2000, and only the differences between the electrical connectors 100, 2100 will be discussed in detail. In addition, components or features described with respect to only one or some of the embodiments described herein are equally applicable to any other embodiments described herein. As such, the electrical connector 2100 may have similar components to other embodiments previously described herein with the similar components including similar reference numbers.

FIG. 29 illustrates the electrical connector 2100 including a terminal block 2105, a set screw 2110, and an anti-backout lock 2115. The illustrated terminal block 2105 includes a base portion 2120 having a mounting aperture 2130 and a raised portion 2125 having a connecting aperture 2140 defining a central axis 2145. The raised portion 2125 includes a first end surface 2150 distal from the base portion 2120 and a second end surface 2155 proximal to the base portion 2120. The raised portion 2125 also includes a threaded aperture 2165 defining a central axis 2170 and is sized to engage threads 2200 of the set screw 2110 so that the set screw 2110 is rotatable in either a first direction 2205 or a second direction 2210. The illustrated set screw 2110 also includes a plurality of slots 2147 extending along an entire length of the side surface of the set screw 2110. In the illustrated embodiment, the plurality of slots 2147 includes four slots equally spaced apart, but in other embodiments, the plurality of slots 2147 can include more or less than four slots.

The illustrated anti-backout lock 2115 includes a ring-shaped base 2151 having radially inward extending protrusions 2153 and radially outward extending protrusions 2157. Each illustrated inwardly extending protrusion 2153 is sized to be received within one of the slots 2147 of the set screw 2110 after each inwardly extending protrusion 2153 is bent (e.g., deformed) about 90 degrees downwardly (FIG. 29 shows one inwardly extending protrusion 2153 bent about 90 degrees relative to the other inwardly extending protrusions 2153). As such, the anti-backout lock 2115 can include no more inwardly extending protrusions 2153 than the amount of slots 2147 formed on the set screw 2110. The illustrated outwardly extending protrusions 2157 include two opposing protrusions that are bendable (e.g., deformable). In other embodiments, the outwardly extending protrusions 2157 can include more or less than two protrusions.

To assemble the electrical connector 2100, the electrical conductor 160 is inserted into the connecting aperture 2140 at the desired depth, and the set screw 2110 is rotated into the threaded aperture 2165 to abut the electrical conductor 160 and to fix the electrical conductor 160 to the terminal block 2105. The inwardly extending protrusions 2153 are bent downwardly so that the anti-backout lock 2115 can slide over a top of the set screw 2110 along the central axis 2170 of the set screw 2110. As such, each inwardly extending protrusion 2153 is received within one slot 2147 and positioned between the set screw 2110 and the threaded aperture 2165. In the illustrated embodiment, the inwardly extending protrusions 2153 are bent so that the inwardly extending protrusions 2153 can still be received within the slots 2147 of the set screw 2110 if the set screw 2110 is positioned below a top surface of the raised portion 2125. In other embodiments, each inwardly extending protrusion 2153 is sized to be received within one slot 2147 without bending each protrusion 2153 (e.g., a length of each inwardly extending protrusion 2153 is about the same as a depth of the slot 2147 formed into the set screw 2110). After the inwardly extending protrusions 2153 are initially received within the slots 2147, the anti-backout lock 2115 is further moved along the central axis 2170 so that the base 2151 abuts a top surface of the terminal block 2105. The outwardly extending protrusions 2157 are then bent over the top surface of the terminal block 2105 so that one outwardly extending protrusion 2157 contacts the first end surface 2150 of the terminal block 2105 and the other outwardly extending protrusion 2157 contacts the second end surface 2155 of the terminal block 2105. The outwardly extending protrusions 2157 inhibit the anti-backout lock 2115 from rotating in the second direction 2210 relative to the terminal block 2105, and the inwardly extending protrusions 2153 inhibit the set screw 2110 from moving relative to the anti-backout lock 2115. Accordingly, the anti-backout lock 2115 is positioned within a locked position (FIG. 30) once the outwardly extending protrusions 2157 contact the first and second end surfaces 2150, 2155 to inhibit the set screw 2110 from rotating in the second direction 2210. In one embodiment, a retaining member 2158 (e.g., a resilient O-ring) can be received onto the set screw 2110 to sandwich the base 2151 against the raised portion 2125 to prevent the anti-backout lock 2115 from sliding off the set screw 2110 prior to and during installation of the electrical connector 2100.

To release the electrical conductor 160 from the electrical connector 2100, the outwardly extending protrusions 2157 are bent out of engagement with the first and second ends 2150, 2155 so that the set screw 2110 can rotate in the second direction 2210.

Figure 31:
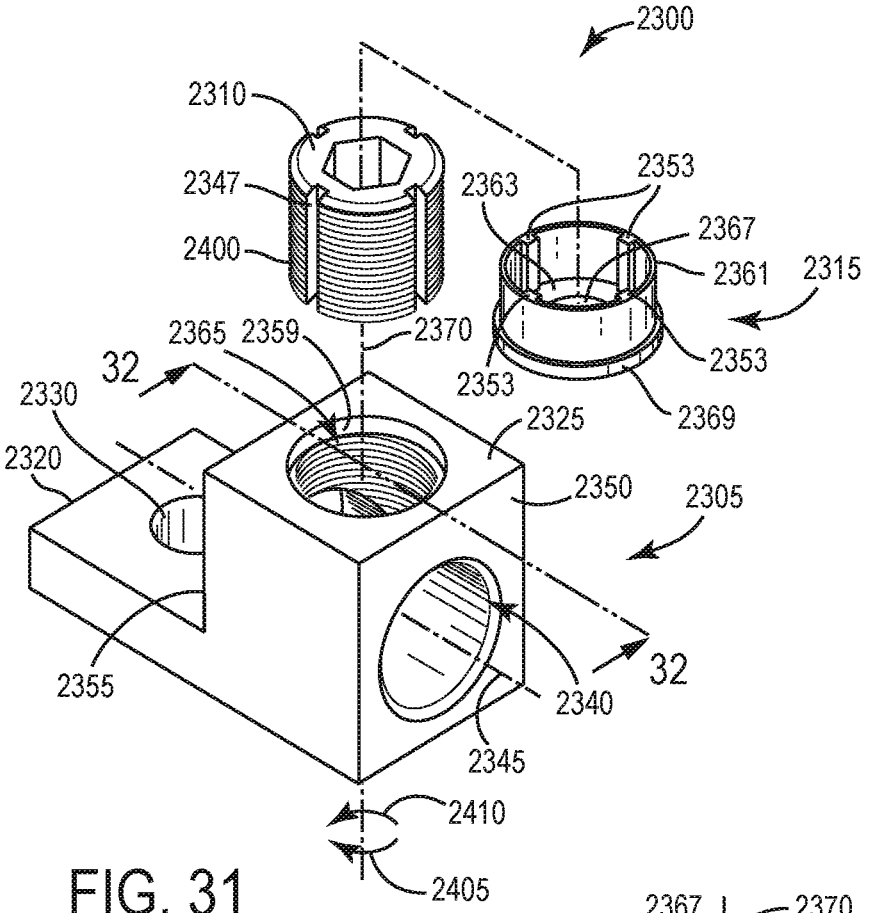
FIG. 31 is an exploded view of an electrical connector including a terminal block, a set screw, and an anti-backout lock according to another embodiment.
Figure 32:
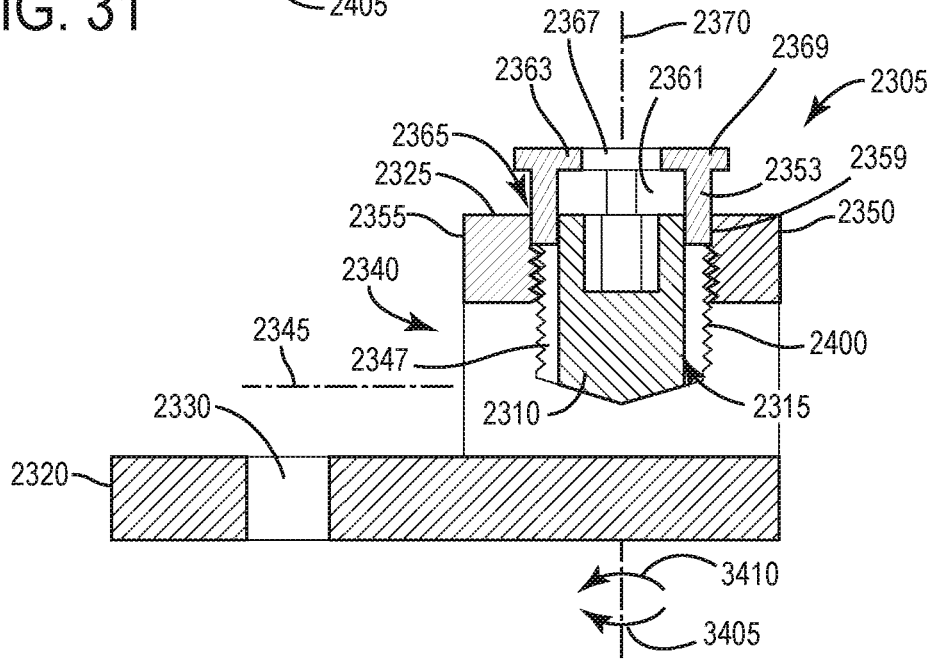
FIG. 32 is a cross sectional view of the electrical connector of FIG. 31 viewed along section 32-32 illustrating the anti-backout lock in a locked position inhibiting movement of the set screw.

FIGS. 31 and 32 illustrate an electrical connector 2300 according to another embodiment. The electrical connector 2300 is similar to the electrical connector 100; therefore, similar components are designated with similar reference numbers plus 2200 and only the differences between the electrical connectors 100, 2300 will be discussed in detail. In addition, components or features described with respect to only one or some of the embodiments described herein are equally applicable to any other embodiments described herein. As such, the electrical connector 2300 may have similar components to other embodiments previously described herein with the similar components including similar reference numbers.

FIG. 31 illustrates the electrical connector 2300 including a terminal block 2305, a set screw 2310 having slots 2347, and an anti-backout lock 2315. The illustrated terminal block 2305 includes a base portion 2320 having a mounting aperture 2330 and a raised portion 232 having a connecting aperture 2340 defining a central axis 2345. The raised portion 2325 includes a first end surface 2350 distal from the base portion 2320 and a second end surface 2355 proximal to the base portion 2320. The raised portion 2325 also includes a threaded aperture 2365 defining a central axis 2370 and is sized to engage threads 2400 of the set screw 2310 so that the set screw 2310 is rotatable in either a first direction 2405 or a second direction 2410. The illustrated raised portion 2325 further includes a counter-bore 2359 concentric with the threaded aperture 2365 and located at an opposite end of the threaded aperture 2365 relative to the connecting aperture 2340.

The illustrated anti-backout lock 2315 is a cap including a circular wall 2361 extending away from a disk-shaped top wall 2363. The circular wall 2361 includes inwardly extending protrusions 2353, and the top wall 2363 includes an aperture 2367 and a rim 2369 extending radially beyond the circular wall 2361. In the illustrated embodiment, the anti-backout lock 2315 is made from rubber. In other embodiments, the anti-backout lock 2315 can be made from other materials (e.g., plastics, etc.).

To assemble the electrical connector 2300, the electrical conductor 160 is inserted into the connecting aperture 2340 at the desired depth, and the set screw 2310 is rotated into the threaded aperture 2365 to abut the electrical conductor 160 and to fix the electrical conductor 160 to the terminal block 2305. The anti-backout lock 2315 is then inserted over a top of the set screw 2310 along the central axis 2370 of the threaded aperture 2365 so that the circular wall 2361 is received within the counter-bore 2359 of the terminal block 2305 and each inwardly extending protrusion 2353 is received within one of the slots 2347 of the set screw 2310. The circular wall 2361 and the inwardly extending protrusions 2353 are sized to provide a snug fit of the anti-backout lock 2315 between the terminal block 2305 and the set screw 2310 to inhibit the set screw 2310 from rotating in the second direction 2410 when the anti-backout lock 2315 is in a locked position (FIG. 32). In other words, the anti-backout lock 2315 is wedged between the terminal block 2305 and the set screw 2310 when in the locked position.

Furthermore, the depth of the anti-backout lock 2315 received within the counter-bore 2359 is dependent upon the thickness of the electrical conductor 160. For example, if the electrical conductor 160 is thicker, a smaller portion of the set screw 2310 is received within the threaded aperture 2365 to fix the electrical conductor 160 to the terminal block 2305 causing a smaller amount of the circular wall 2361 to be received within the counter-bore 2359 than if a thinner electrical conductor 160 is received within the connecting aperture 2340. As such, the length of the circular wall 2361 is dependent upon a thickness of the electrical conductor 160 and/or a diameter of the connecting aperture 2340.

To release the electrical conductor 160 from the electrical connector 2300, the rim 2369 of the anti-backout lock 2315 can be gripped or a tool (e.g., a screwdriver, etc.) can be inserted into the aperture 2367 to remove (e.g., pry) the anti-backout lock 2315 away from the terminal block 2305. Thereafter, the set screw 2310 can rotate in the second direction 2410.

Figure 33:
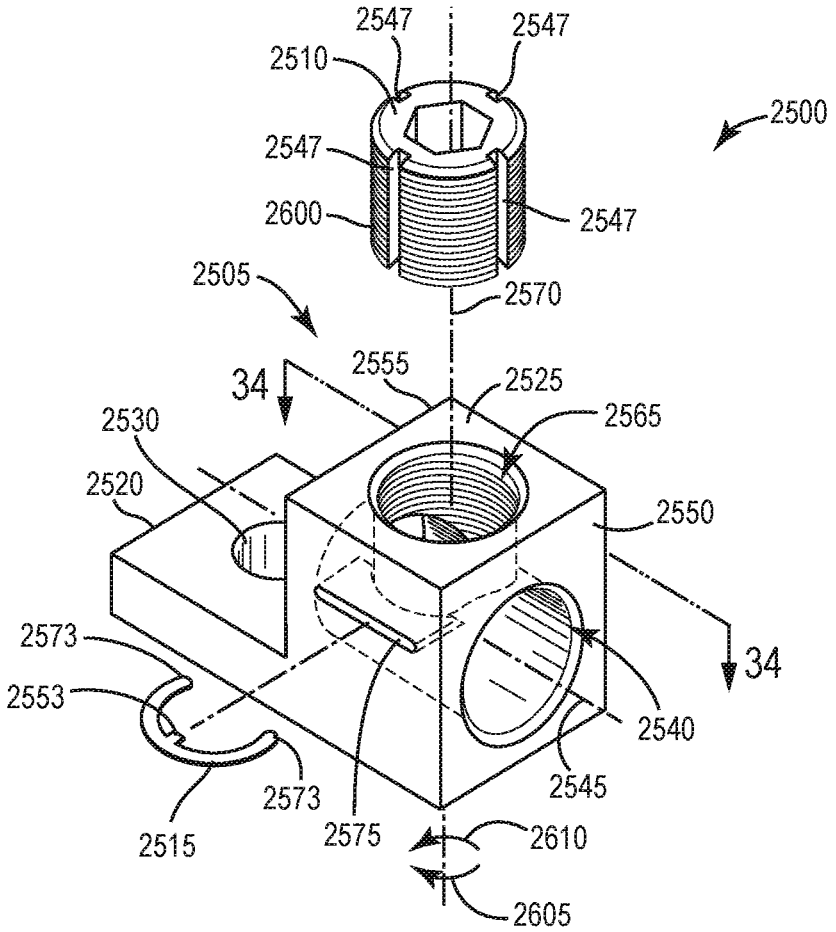
FIG. 33 is an exploded view of an electrical connector including a terminal block, a set screw, and an anti-backout lock according to another embodiment.
Figure 34:
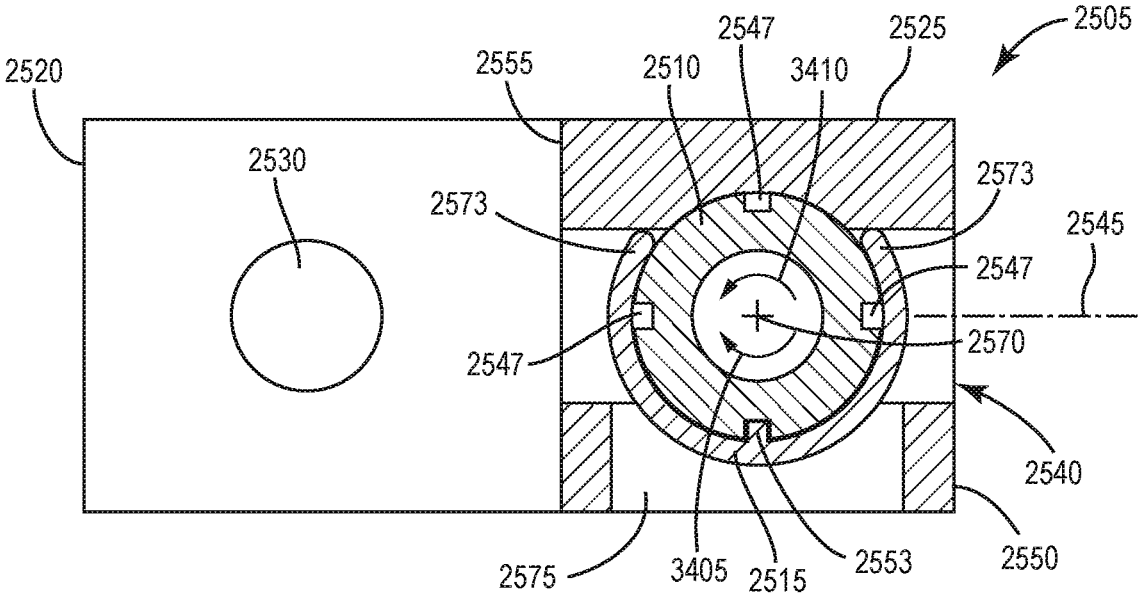
FIG. 34 is a perspective view of the electrical connector of FIG. 33 viewed along section 34-34 illustrating the anti-backout lock in a locked position inhibiting movement of the set screw.

FIGS. 33 and 34 illustrate an electrical connector 2500 according to another embodiment. The electrical connector 2500 is similar to the electrical connector 100; therefore, similar components are designated with similar reference numbers plus 2400, and only the differences between the electrical connectors 100, 2500 will be discussed in detail. In addition, components or features described with respect to only one or some of the embodiments described herein are equally applicable to any other embodiments described herein. As such, the electrical connector 2500 may have similar components to other embodiments previously described herein with the similar components including similar reference numbers.

FIG. 33 illustrates the electrical connector 2500 including a terminal block 2505, a set screw 2510 having slots 2547, and an anti-backout lock 2515. The illustrated terminal block 2505 includes a base portion 2520 having a mounting aperture 2530 and a raised portion 2525 having a connecting aperture 2540 defining a central axis 2545. The raised portion 2525 includes a first end surface 2550 distal from the base portion 2520 and a second end surface 2555 proximal to the base portion 2520. The raised portion 2525 also includes a threaded aperture 2565 defining a central axis 2570 and is sized to engage threads 2600 of the set screw 2510 so that the set screw 2510 is rotatable in either a first direction 2605 or a second direction 2610. The illustrated raised portion 2525 further includes an anti-backout lock aperture 2575 (e.g., slot) formed within a side of the raised portion 2525 between the end surfaces 2550, 2555 to define a plane substantially parallel to the central axis 2545 of the connecting aperture 2540 and substantially perpendicular to the central axis 2570 of the threaded aperture 2565. As best shown in FIG. 34, the anti-backout lock aperture 2575 extends through the raised portion 2525 so that a portion of the anti-backout lock aperture 2575 is located at a bottom end of the threaded aperture 2565 (e.g., the anti-backout lock aperture 2575 is positioned between the connecting aperture 2540 and the threaded aperture 2565 in a direction parallel to the central axis 2570 of the threaded aperture 2565). The anti-backout lock aperture 2575 also includes a width greater than a diameter of the threaded aperture 2565. In other embodiments, the anti-backout lock aperture 2575 can be positioned closer to the top surface of the raised portion 2525 so that the anti-backout lock aperture 2575 intersects the threaded aperture 2565.

The illustrated anti-backout lock 2515 is a C-ring lock having opposite ends 2573 and a single inwardly extending protrusion 2553 located between the ends 2573.

To assemble the electrical connector 2500, the electrical conductor 160 is inserted into the connecting aperture 2540 at the desired depth, and the set screw 2510 is rotated into the threaded aperture 2565 to abut the electrical conductor 160 and to fix the electrical conductor 160 to the terminal block 2505. The set screw 2510 is also oriented so that one of the slots 2547 of the set screw 2510 is perpendicular to an opening of the anti-backout lock aperture 2575 formed in the raised portion 2525. In one embodiment, the top surface of the raised portion 2525 can include a mark so that one of the slots 2547 of the set screw 2510 can align with the mark to properly align the one slot 2547 with the opening of the anti-backout lock aperture 2575 formed in the raised portion 2525. The anti-backout lock 2515 is then inserted into the anti-backout lock aperture 2575 for the inwardly extending protrusion 2553 to engage the one slot 2547 of the set screw 2510. In some embodiments, the anti-backout lock aperture 2575 formed in the raised portion 2525 is sized to receive a tool (e.g., flathead screwdriver, etc.) so that the tool can push the anti-backout lock 2515 into engagement with the set screw 2510. Once the inwardly extending protrusion 2553 engages the one slot 2547 of the set screw 2510, the set screw 2510 is in a lock position (FIG. 34) and inhibited from rotating in the first and second directions 2605, 2610. In particular, if the set screw 2510 is slightly rotated in either direction 2605, 2610, one end 2573 of the anti-backout lock 2515 will contact a wall of one of the connecting aperture 2540 and the threaded aperture 2565 to inhibit the rotation of the set screw 2510.

To release the electrical conductor 160 from the electrical connector 2500, the set screw 2510 is torqued until the inwardly extending protrusion 2553 is sheared off of the anti-backout lock 2515 allowing the set screw 2510 to be rotated in the second direction 2610. In other embodiments, the anti-backout lock aperture 2575 of the raised portion 2525 completely extends through the raised portion 2525 so that a tool can be inserted into the anti-backout lock aperture 2575 to push the anti-backout lock 2515 out through the opening of the anti-backout lock aperture 2575, which first received the anti-backout lock 2515.

Figure 35:
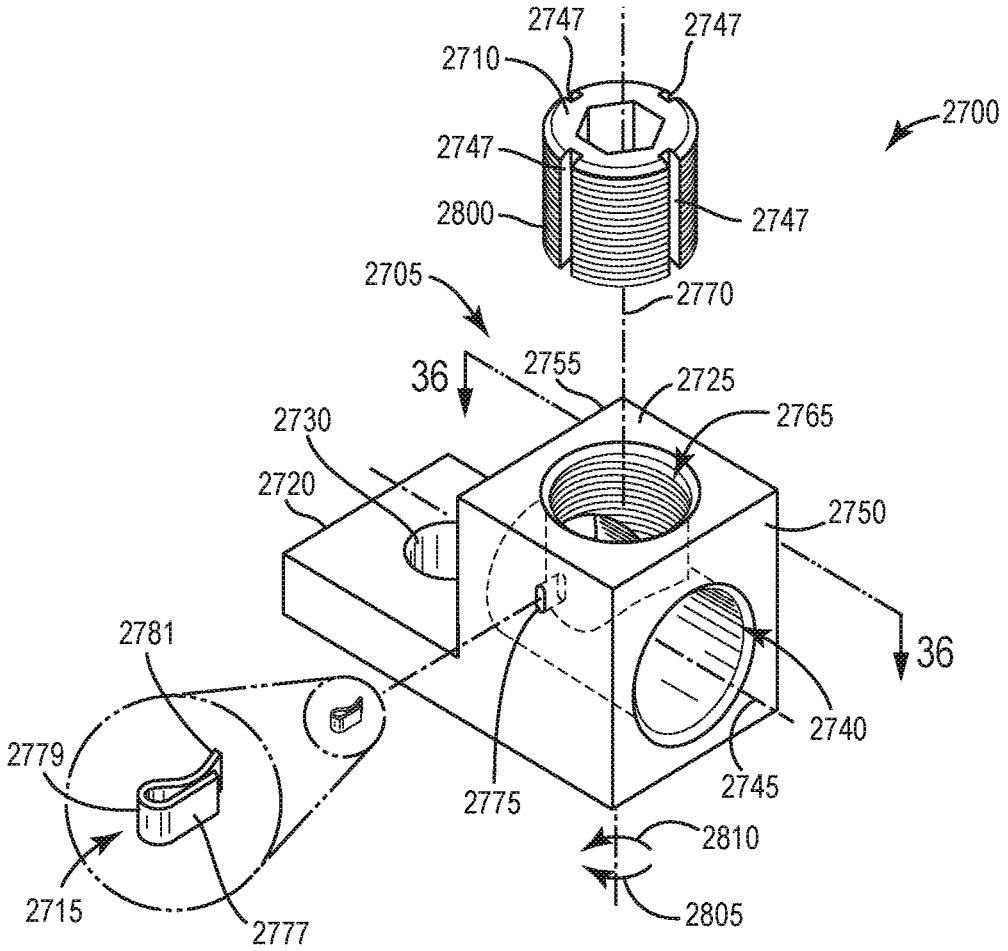
FIG. 35 is an exploded view of an electrical connector including a terminal block, a set screw, and an anti-backout lock according to another embodiment.
Figure 36:
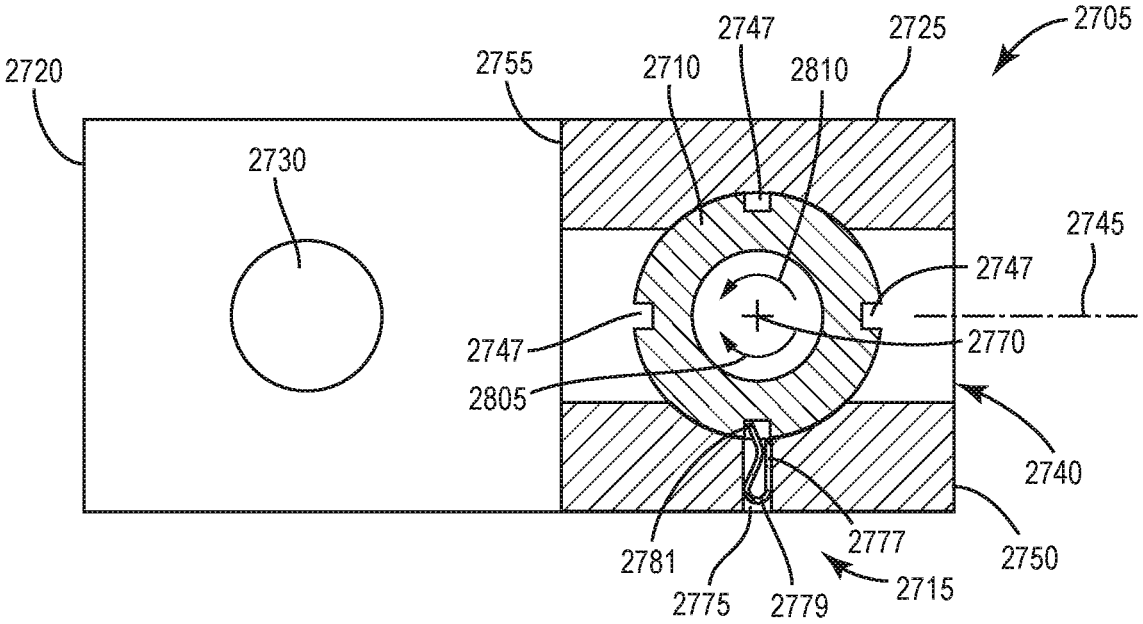
FIG. 36 is a perspective view of the electrical connector of FIG. 35 viewed along section 36-36 illustrating the anti-backout lock in a locked position inhibiting movement of the set screw.

FIGS. 35 and 36 illustrate an electrical connector 2700 according to another embodiment. The electrical connector 2700 is similar to the electrical connector 100; therefore, similar components are designated with similar reference numbers plus 2600, and only the differences between the electrical connectors 100, 2700 will be discussed in detail. In addition, components or features described with respect to only one or some of the embodiments described herein are equally applicable to any other embodiments described herein. As such, the electrical connector 2700 may have similar components to other embodiments previously described herein with the similar components including similar reference numbers.

FIG. 35 illustrates the electrical connector 2700 including a terminal block 2705, a set screw 2710 having slots 2747, and an anti-backout lock 2715. The illustrated terminal block 2705 includes a base portion 2720 having a mounting aperture 2730 and a raised portion 2725 having a connecting aperture 2740 defining a central axis 2745. The raised portion 2725 includes a first end surface 2750 distal from the base portion 2720 and a second end surface 2755 proximal to the base portion 2720. The raised portion 2725 also includes a threaded aperture 2765 defining a central axis 2770 and is sized to engage threads 2800 of the set screw 2710 so that the set screw 2710 is rotatable in either a first direction 2805 or a second direction 2810. The illustrated raised portion 2725 further includes an anti-backout lock aperture 2775 (e.g., slot) formed within a side of the raised portion 2725 between the end surfaces 2750, 2755 to define a plane substantially perpendicular to the central axis 2745 of the connecting aperture 2740 and substantially parallel to the central axis 2770 of the threaded aperture 2765. As best shown in FIG. 36, the anti-backout lock aperture 2775 extends through the raised portion 2725 so that the anti-backout lock aperture 2775 is in communication with the threaded aperture 2765. In other embodiments, the anti-backout lock aperture 2775 can be positioned further from the top surface of the raised portion 2725 so that the anti-backout lock aperture 2775 is in communication with the connecting aperture 2740.

The illustrated anti-backout lock 2715 is a resilient lock clip having a planar arm 2777 coupled to a loop end 2779 with the loop end 2779 coupled to a resilient arm 2781. In the illustrated embodiment, the resilient arm 2781 extends beyond the planar arm 2777 in a direction opposite the loop end 2779. The resilient arm 2781 is obliquely angled relative to the planar arm 2777. In other embodiments, the resilient arm 2781 and the planar arm 2777 can extend the same distance from the lop end 2779 or the planar arm 2777 can extend beyond the resilient arm 2781 in the direction opposite the loop end 2779.

To assemble the electrical connector 2700, the electrical conductor 160 is inserted into the connecting aperture 2740 at the desired depth, and the set screw 2710 is rotated into the threaded aperture 2765 to abut the electrical conductor 160 and to fix the electrical conductor 160 to the terminal block 2705. The set screw 2710 is also oriented so that one of the slots 2747 of the set screw 2710 aligns with the anti-backout lock aperture 2775 formed in the raised portion 2725. In one embodiment, the top surface of the raised portion 2725 can include a mark to aid in alignment between the slots 2747 and the anti-backout lock aperture 2775. The anti-backout lock 2715 is then inserted into the anti-backout lock aperture 2775 formed in the raised portion 2725 for at least the resilient arm 2781 to be received within the one slot 2747 of the set screw 2510. In other embodiments, both the planar arm 2777 and the resilient arm 2781 are received within the one slot 2747. Once the resilient arm 2781 is received within the one slot 2747, the set screw 2710 is in a lock position (FIG. 36) and is inhibited from rotating in the first and second directions 2805, 2810.

In one embodiment, the loop end 2779 extends beyond the side of the terminal block 2705 so that a tool (e.g., pliers, pin, etc.) can grip the anti-backout lock 2715 to remove the anti-backout lock 2715 from the terminal block 2705. As such, the electrical conductor 160 can be removed from the electrical connector 2700 after the set screw 2710 is rotated in the second direction 2810.

Figure 37:
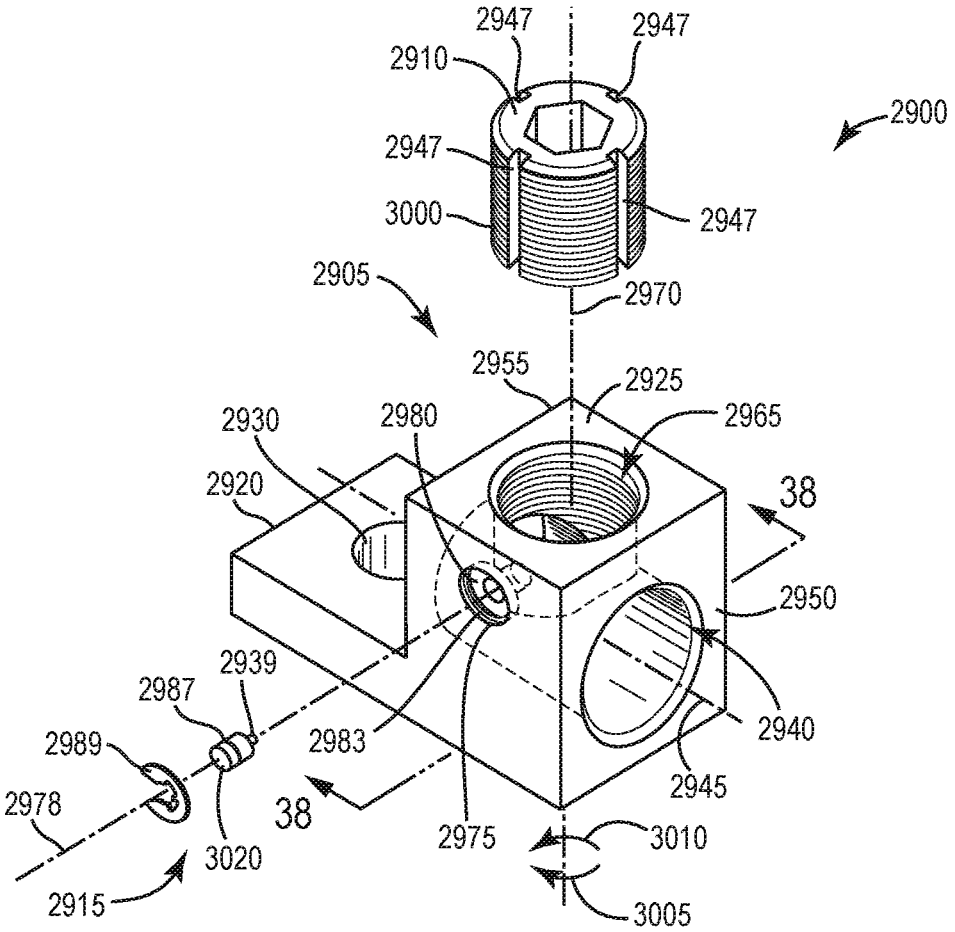
FIG. 37 is an exploded view of an electrical connector including a terminal block, a set screw, and an anti-backout lock according to another embodiment.
Figure 38:
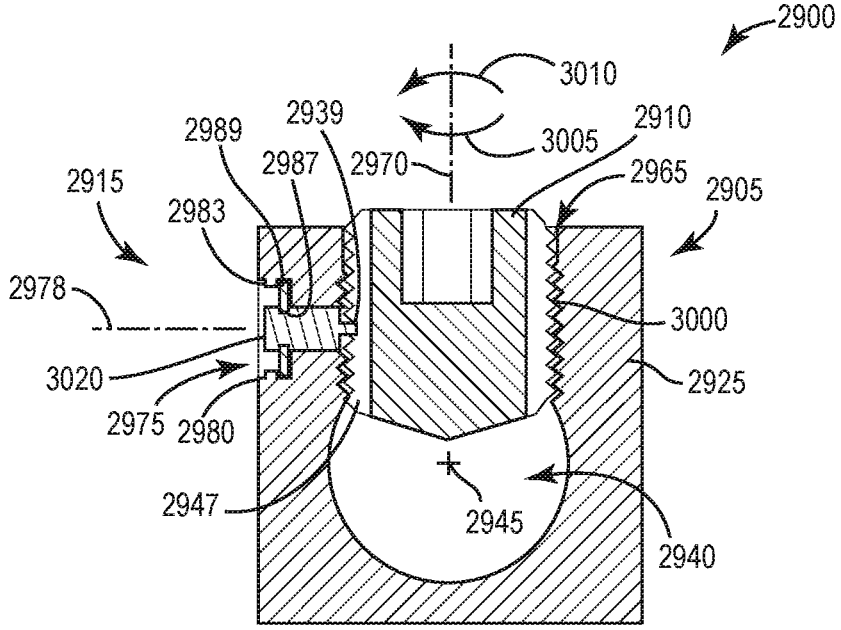
FIG. 38 is a cross sectional view of the electrical connector of FIG. 37 viewed along section 38-38 illustrating the anti-backout lock in a locked position inhibiting movement of the set screw.

FIGS. 37 and 38 illustrate an electrical connector 2900 according to another embodiment. The electrical connector 2900 is similar to the electrical connector 100; therefore, similar components are designated with similar reference numbers plus 2800, and only the differences between the electrical connectors 100, 2900 will be discussed in detail. In addition, components or features described with respect to only one or some of the embodiments described herein are equally applicable to any other embodiments described herein. As such, the electrical connector 2900 may have similar components to other embodiments previously described herein with the similar components including similar reference numbers.

FIG. 37 illustrates the electrical connector 2900 including a terminal block 2905, a set screw 2910 having slots 2947, and an anti-backout lock 2915. The illustrated terminal block 2905 includes a base portion 2920 having a mounting aperture 2930 and a raised portion 2925 having a connecting aperture 2940 defining a central axis 2945. The raised portion 2925 includes a first end surface 2950 distal from the base portion 2920 and a second end surface 2955 proximal to the base portion 2920. The raised portion 2925 also includes a threaded aperture 2965 defining a central axis 2970 and is sized to engage threads 3000 of the set screw 2910 so that the set screw 2910 is rotatable in either a first direction 3005 or a second direction 3010. The illustrated raised portion 2925 further includes an anti-backout lock aperture 2975 having a central axis 2978 perpendicular to the central axes 2945, 2970 of the connecting aperture 2940 and the threaded aperture 2965. The anti-backout lock aperture 2975 includes a counter-bore 2980 with a circumferential rib 2983 formed within the counter-bore 2980. In the illustrated embodiment, the circumferential rib 2983 is located within the counter-bore 2980 to separate the counter-bore 2980 into two equal portions on opposing sides of the counter-bore 2980.

The illustrated anti-backout lock 2915 is a pin including a shaft 3020 having a groove 2987 and a protrusion 2939. The anti-backout lock 2915 also includes a resilient retaining C-shaped ring 2989 sized to be partially received within the groove 2987.

To assemble the electrical connector 2900, the electrical conductor 160 is inserted into the connecting aperture 2940 at the desired depth, and the set screw 2910 is rotated into the threaded aperture 2965 to abut the electrical conductor 160 and to fix the electrical conductor 160 to the terminal block 2905. The set screw 2910 is also oriented so that one of the slots 2947 of the set screw 2910 aligns with the anti-backout lock aperture 2975 formed in the raised portion 2925 (e.g., the central axis 2978 of the anti-backout lock aperture 2975 intersects one slot 2947 of the set screw 2910). In one embodiment, the top surface of the raised portion 2925 can include a mark to aid in alignment between the slot 2747 and the anti-backout lock aperture 2975. The retaining ring 2989 is received within the groove 2987 and then both the retaining ring 2989 and the shaft 3020 are inserted into the anti-backout lock aperture 2975 so that the retaining ring 2989 moves past the circumferential rib 2983 and the protrusion 2939 is received within one slot 2947 of the set screw 2910. With the retaining ring 2989 moved past the circumferential rib 2983, the anti-backout lock 2915 is retained within the anti-backout lock aperture 2975. Once the protrusion 2939 is received within a slot 2947 of the set screw 2910, the anti-backout lock 2915 is in a lock position (FIG. 38) and the set screw 2915 is inhibited from rotating in either direction 3005, 3010.

To remove the anti-backout lock 2915 from the terminal block 2905 to loosen the set screw 2910 and remove the electrical conductor 160, a tool (e.g., pliers, etc.) engages an end of the shaft 3020 opposite the protrusion 2939 to pull the shaft 3020 and the retaining ring 2989 from the anti-backout lock aperture 2975.

Figure 39:
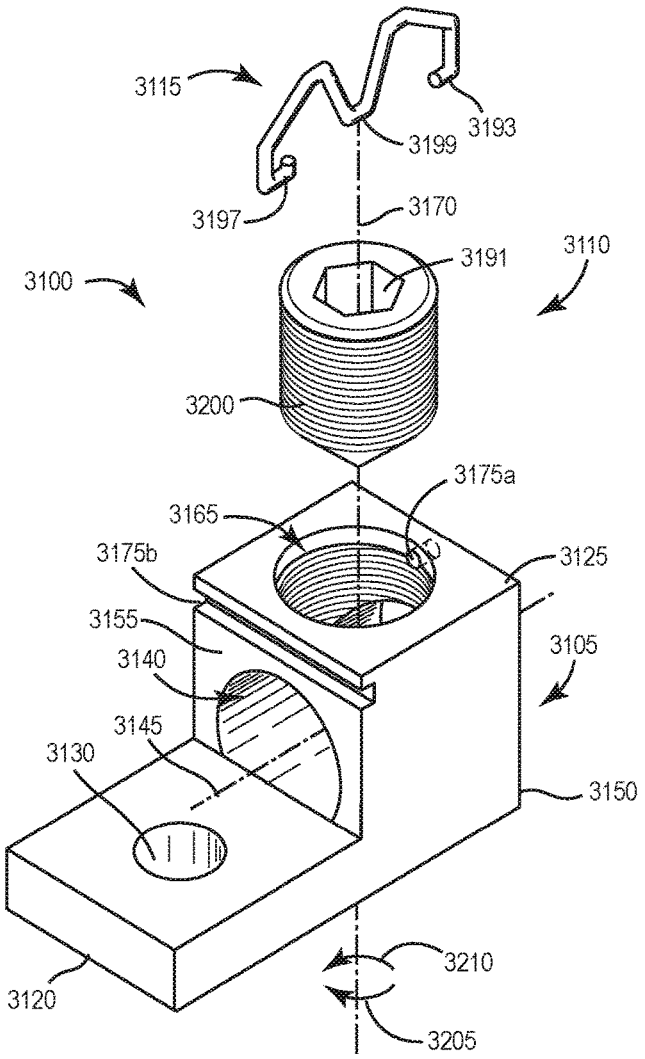
FIG. 39 is an exploded view of an electrical connector including a terminal block, a set screw, and an anti-backout lock according to another embodiment.
Figure 40:
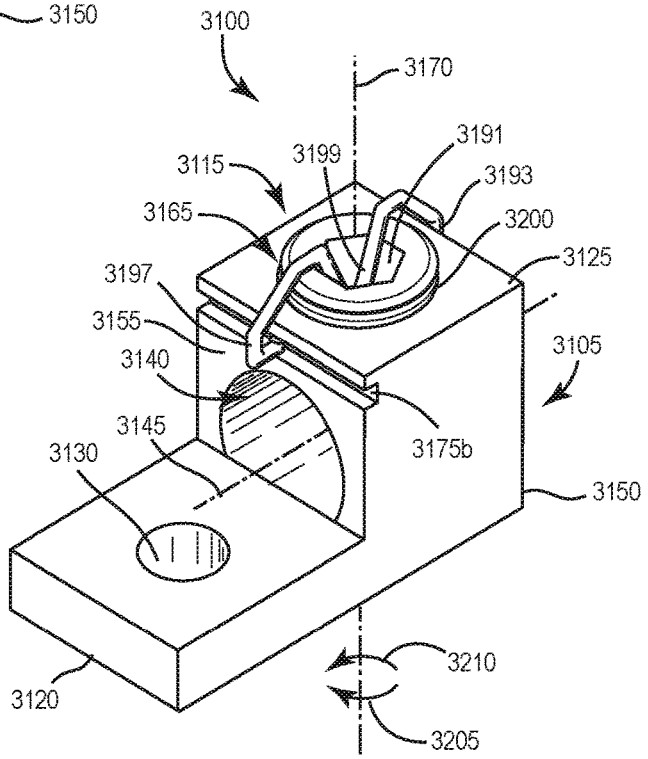
FIG. 40 is a perspective view of the electrical connector of FIG. 39 in a locked state inhibiting movement of the set screw.

FIGS. 39 and 40 illustrate an electrical connector 3100 according to another embodiment. The electrical connector 3100 is similar to the electrical connector 100; therefore, similar components are designated with similar reference numbers plus 3000, and only the differences between the electrical connectors 100, 3100 will be discussed in detail. In addition, components or features described with respect to only one or some of the embodiments described herein are equally applicable to any other embodiments described herein. As such, the electrical connector 3100 may have similar components to other embodiments previously described herein with the similar components including similar reference numbers.

FIG. 39 illustrates the electrical connector 3100 including a terminal block 3105, a set screw 3110, and an anti-backout lock 3115. The set screw 3110 also includes a drive aperture 3191 sized to receive a tool that rotates the set screw 3110. In the illustrated embodiment, the drive aperture 3191 is a hexagonal-shaped drive aperture sized to receive an Allen wrench. In other embodiments, the drive aperture 3191 can be at least one slot sized to receive a screwdriver (i.e., a flathead screwdriver or Phillips head screwdriver). In further embodiments, the drive aperture 3191 can include a different shape to receive a different tool (e.g., a tori drive screwdriver, a square drive screwdriver, etc.). In yet further embodiments, the drive aperture 3191 can be a drive protrusion sized to be received by a socket wrench or the like.

The illustrated terminal block 3105 includes a base portion 3120 having a mounting aperture 3130 and a raised portion 3125 having a connecting aperture 3140 defining a central axis 3145. The raised portion 3125 includes a first end surface 3150 distal from the base portion 3120 and a second end surface 3155 proximal to the base portion 3120. The raised portion 3125 also includes a threaded aperture 3165 defining a central axis 3170 and is sized to engage threads 3200 of the set screw 3110 so that the set screw 3110 is rotatable in either a first direction 3205 or a second direction 3210. The illustrated raised portion 3125 further includes a first anti-backout lock aperture **3175*a* formed within the first end surface 3150 of the raised portion 3125** and a second anti-backout lock aperture 3175*b* formed within the second end surface 3155 of the raised portion 3125. In the illustrated embodiment, the first anti-backout lock aperture 3175*a* is a through hole in communication with the threaded aperture 3165 with a central axis of the first anti-backout lock aperture 3175*a* oriented substantially parallel to the central axis 3145 of the connecting aperture 3140 and substantially perpendicular to the central axis 3170 of the threaded aperture 3165. The illustrated second anti-backout lock aperture 3175*b* is a channel having a longitudinal axis oriented substantially perpendicular to the central axes 3145, 3170 of the connecting aperture 3140 and the threaded aperture 3165. In other embodiments, the first anti-backout lock aperture 3175*a* can be the same as the second anti-backout lock aperture 3175*b* or the second anti-backout lock aperture 3175*b* can be the same as the first anti-backout lock aperture 3175*a*. In further embodiments, the first anti-backout lock aperture 3175*a* may not be a through hole that is in communication with the threaded aperture 3165, but rather, the first anti-backout lock aperture 3175*a* can be a recess within the first end surface 3150 of the raised portion 3125.

The illustrated anti-backout lock 3115 is a resilient wire clip having a first hook end 3193, a second hook end 3197, and a protrusion 3199 (e.g., V-shaped protrusion formed by two legs) positioned between the first and second hook ends 3193, 3197.

To assemble the electrical connector 3100, the electrical conductor 160 is inserted into the connecting aperture 3140 at the desired depth, and the set screw 3110 is rotated into the threaded aperture 3165 to abut the electrical conductor 160 and to fix the electrical conductor 160 to the terminal block 3105. The anti-backout lock 3115 is then coupled to the terminal block 3105 and the set screw 3110 in a locked position (FIG. 40). In particular, the first hook end 3193 is received within the first anti-backout lock aperture 3175*a*, the second hook end 3197 is received within the second anti-backout lock aperture 3175*b*, and the protrusion 3199 is received within the drive aperture 3191 of the set screw 3110. In the illustrated embodiment, the protrusion 3199 is received within the drive aperture 3191 so that the each leg of the protrusion 3199 is seated in an opposing edge of the hexagonal-shaped drive aperture 3191. As a result, the set screw 3110 is inhibited from rotating in either direction 3205, 3210.

To remove the anti-backout lock 3115 to loosen the set screw 3110 and remove the electrical conductor 160, the first and second hook ends 3193, 3197 are removed from the first and second anti-backout lock apertures 3175*a*, 3175*b* to remove the protrusion 3199 from the drive aperture 3191.

Figure 41:
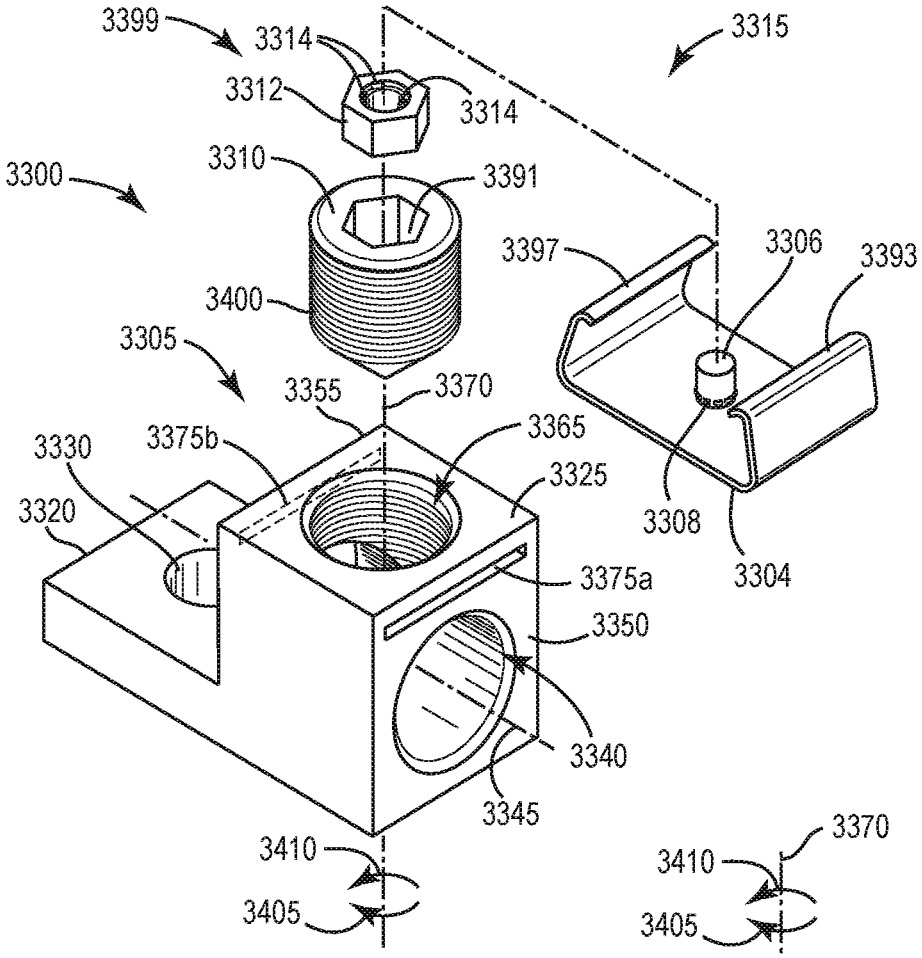
FIG. 41 is an exploded view of an electrical connector including a terminal block, a set screw, and an anti-backout lock according to another embodiment.
Figure 42:
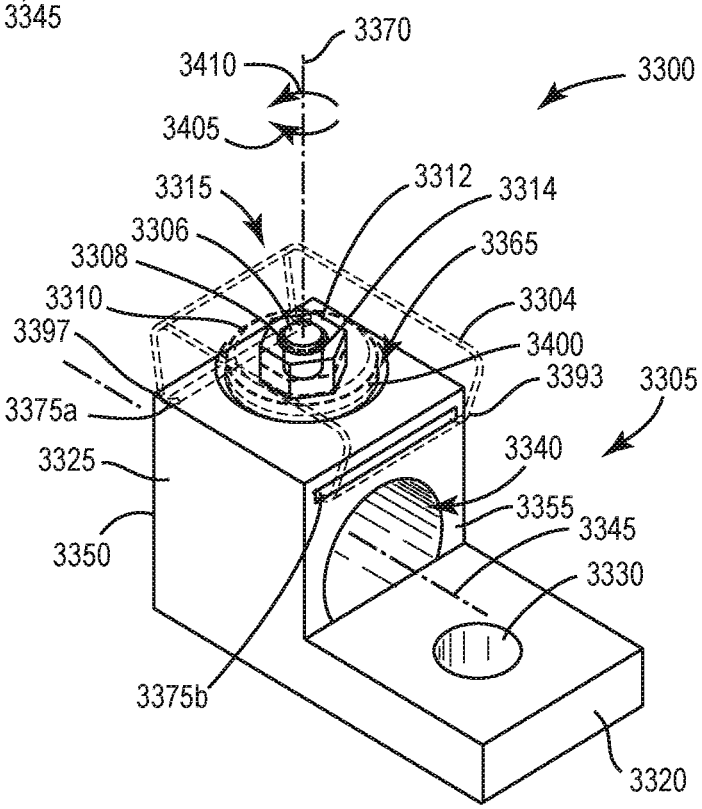
FIG. 42 is a perspective view of the electrical connector of FIG. 41 in a locked state inhibiting movement of the set screw.

FIGS. 41 and 42 illustrate an electrical connector 3300 according to another embodiment. The electrical connector 3300 is similar to the electrical connector 100; therefore, similar components are designated with similar reference numbers plus 3200, and only the differences between the electrical connectors 100, 3300 will be discussed in detail. In addition, components or features described with respect to only one or some of the embodiments described herein are equally applicable to any other embodiments described herein. As such, the electrical connector 3300 may have similar components to other embodiments previously described herein with the similar components including similar reference numbers.

FIG. 41 illustrates the electrical connector 3300 including a terminal block 3305, a set screw 3310, and an anti-backout lock 3315. The set screw 3310 also includes a drive aperture 3391 sized to receive a tool (e.g., Allen wrench) that rotates the set screw 3310. The illustrated terminal block 3305 includes a base portion 3320 having a mounting aperture 3330 and a raised portion 3325 having a connecting aperture 3340 defining a central axis 3345. The raised portion 3325 includes a first end surface 3350 distal from the base portion 3320 and a second end surface 3355 proximal to the base portion 3320. The raised portion 3325 also includes a threaded aperture 3365 defining a central axis 3370 and is sized to engage threads 3400 of the set screw 3310 so that the set screw 3310 is rotatable in either a first direction 3405 or a second direction 3410. The illustrated raised portion 3325 further includes a first anti-backout lock aperture 3375*a* formed within the first end surface 3350 of the raised portion 3325 and a second anti-backout lock aperture 3375*b* formed within the second end surface 3355 of the raised portion 3325. In the illustrated embodiment, the first and second anti-backout lock apertures 3375*a*, 3375*b* are slots having a longitudinal axis oriented substantially perpendicular to the central axes 3345, 3370 of the connecting aperture 3340 and the threaded aperture 3365.

The illustrated anti-backout lock 3315 includes a bracket 3304 having a resilient first hook end 3393 and a resilient second hook end 3397 with a protrusion 3399 coupled to the bracket 3304 and positioned between the first and second hook ends 3393, 3397, The illustrated protrusion 3399 includes a shaft 3306 fixed to the bracket 3304 and having ratchet teeth 3308. The protrusion 3399 also includes a stud 3312 having pawls 3314 that are sized to engage the ratchet teeth 3308 so that the stud 3312 can only rotate relative to the shaft 3306 in one direction. The stud 3312 is sized to be received within the drive aperture 3391 of the set screw 3310. In other embodiments, the stud 3312 can be fixed to the shaft 3306 so that the ratchet teeth 3308 and the pawls 3314 can be omitted.

To assemble the electrical connector 3300, the electrical conductor 160 is inserted into the connecting aperture 3340 at the desired depth, and the set screw 3310 is rotated into the threaded aperture 3365 to abut the electrical conductor 160 and to fix the electrical conductor 160 to the terminal block 3305. The anti-backout lock 3315 is then coupled to the terminal block 3305 and the set screw 3310 in a locked position (FIG. 42). In particular, once the stud 3312 engages the drive aperture 3391 of the set screw 3310, the bracket 3304 is rotated in the first direction 3405 relative to the stud 3312 so that the first and second hook ends 3393, 3397 align with the first and second anti-backout lock apertures 3375*a*, 3375*b*, respectively. With movement of the anti-backout lock 3315 toward the set screw 3310, the first and second hook ends 3393, 3397 expand over the sides of the raised portion 3325 to then be received within the first and second anti-backout lock apertures 3375*a*, 3375*b*, respectively. Engagement of the first and second hook ends 3393, 3397 and the first and second anti-backout lock apertures 3375*a*, 3375*b* prevents the anti-backout lock 3315 from inadvertently disengaging from the terminal block 3305. As a result, the set screw 3310 is inhibited from rotating relative to the anti-backout lock 3315 in the second direction 3410.

To remove the anti-backout lock 3315 to loosen the set screw 3310 and remove the electrical conductor 160, the first and second hook ends 3393, 3397 are removed from the first and second anti-backout lock apertures 3375*a*, 3375*b* to remove the stud 3312 from the drive aperture 3391.

Figure 43:
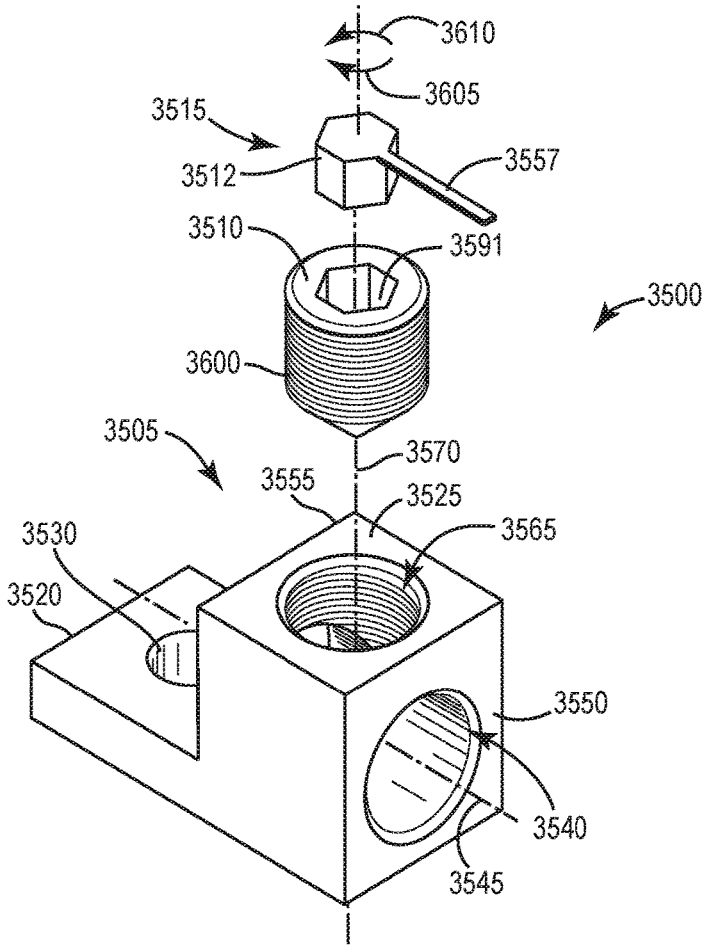
FIG. 43 is an exploded view of an electrical connector including a terminal block, a set screw, and an anti-backout lock according to another embodiment.
Figure 44:
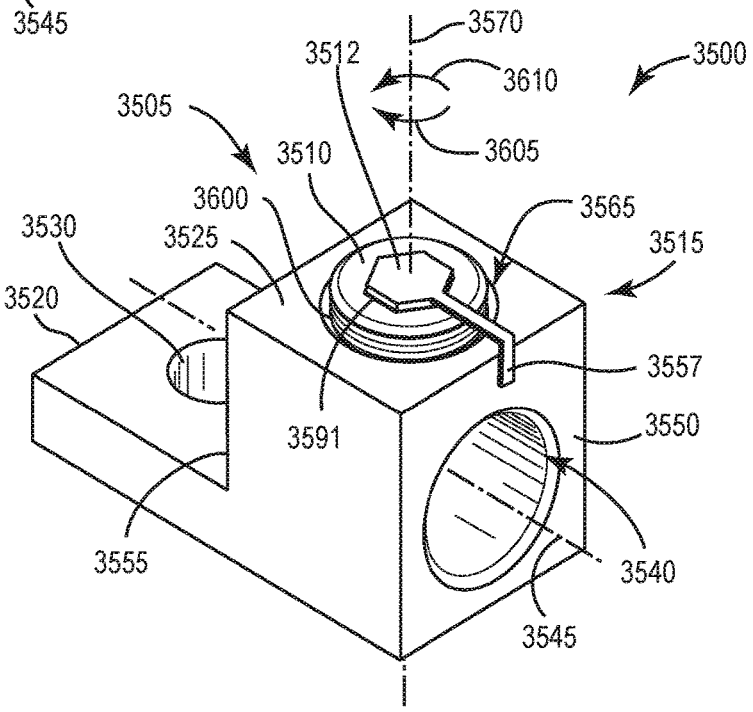
FIG. 44 is a perspective view of the electrical connector of FIG. 43 in a locked state inhibiting movement of the set screw.

FIGS. 43 and 44 illustrate an electrical connector 3500 according to another embodiment. The electrical connector 3500 is similar to the electrical connector 100; therefore, similar components are designated with similar reference numbers plus 3400, and only the differences between the electrical connectors 100, 3500 will be discussed in detail. In addition, components or features described with respect to only one or some of the embodiments described herein are equally applicable to any other embodiments described herein. As such, the electrical connector 3500 may have similar components to other embodiments previously described herein with the similar components including similar reference numbers.

FIG. 43 illustrates the electrical connector 3500 including a terminal block 3505, a set screw 3510, and an anti-backout lock 3515. The set screw 3510 also includes a drive aperture 3591 sized to receive a tool (e.g., Allen wrench) that rotates the set screw 3510. The illustrated terminal block 3505 includes a base portion 3520 having a mounting aperture 3530 and a raised portion 3525 having a connecting aperture 3540 defining a central axis 3545. The raised portion 3525 includes a first end surface 3550 distal from the base portion 3520 and a second end surface 3555 proximal to the base portion 3520. The raised portion 3525 also includes a threaded aperture 3565 defining a central axis 3570 and is sized to engage threads 3600 of the set screw 3510 so that the set screw 3510 is rotatable in either a first direction 3605 or a second direction 3610.

The illustrated anti-backout lock 3515 includes an outwardly extending protrusion 3557 coupled to a stud 3512. In one embodiment, the stud 3512 is a solid stud, or the stud 3512 can be a hollow stud. In other embodiments, more than one outwardly extending protrusion 3557 can be coupled to the stud 3512 (e.g., two opposing protrusions 3557). The illustrated stud 3512 is sized to be received within the drive aperture 3591.

To assemble the electrical connector 3500, the electrical conductor 160 is inserted into the connecting aperture 3540 at the desired depth, and the set screw 3510 is rotated into the threaded aperture 3565 to abut the electrical conductor 160 and to fix the electrical conductor 160 to the terminal block 3505. The anti-backout lock 3515 is then coupled to the terminal block 3505 and the set screw 3510 in a locked position (FIG. 44). In particular, the stud 3512 engages the set screw 3510 so that the outwardly extending protrusion 3557 extends beyond a side of the raised portion 3525 of the terminal block 3505. Then a portion of the outwardly extending protrusion 3557 is bent over the side of the raised portion 3525 to engage the first end surface 3550 of the raised portion 3525. In other embodiments, the outwardly extending protrusion 3557 can engage the second end surface 3555 or one of the side surfaces of the raised portion 3525 positioned between the first and second end surfaces 3550, 3555. In the illustrated embodiment, the drive aperture 3591 is oriented relative to the terminal block 3505 in such a way that the outwardly extending protrusion 3557 is substantially parallel to the central axis 3545 of the connecting aperture 3540. In other embodiments and before the outwardly extending protrusion 3557 is bent over the terminal block 3505, the set screw 3510 can be positioned within the threaded aperture 3565 to position the drive aperture 3591 in such a way that the outwardly extending protrusion 3557 is obliquely angled relative to the central axis 3545 of the connecting aperture 3540 (e.g., the set screw 3510 and the anti-backout lock 3515 are slightly rotated in the second direction 3610 from what is illustrated in FIG. 44). As such, when the outwardly extending protrusion 3557 is bent over the terminal block 3505, the anti-backout lock 3515 inhibits movement of the set screw 3510 in the second direction 3610, but allows movement of the set screw 3510 in the first direction 3605.

To remove the anti-backout lock 3515 to loosen the set screw 3510 and remove the electrical conductor 160, the bent portion of the outwardly extending protrusion 3557 is moved to disengage from the terminal block 3505 to allow removal of the stud 3512 from the drive aperture 3591.

Although the disclosure has been described with reference to certain preferred embodiments, variations and modifications exist within the scope and spirit of one or more independent aspects of the disclosure as described.

The invention claimed is:

1. An electrical connector configured to couple an electrical conductor to a support surface of an electrical device, the electrical connector comprising:

a terminal block including a connecting aperture and a threaded aperture, the connecting aperture configured to receive the electrical conductor;

a fastener including threads receivable within the threaded aperture, the fastener configured to move in a first rotational direction relative to the threaded aperture; and a lock configured to be positioned between the electrical conductor and the fastener to engage the electrical conductor and the fastener, rotation of the fastener in the first rotational direction causing the lock to secure the electrical conductor against movement relative to the terminal block, wherein the lock restricts movement of the fastener in a second rotational direction, and wherein movement of the fastener in the second rotational direction is configured to release the electrical conductor from the terminal block.

2. The electrical connector of claim 1, wherein the lock is sized to be receivable within the threaded aperture.

3. The electrical connector of claim 2, wherein the lock includes a first side having teeth, and wherein the teeth of the first side are configured to engage one of the fastener and the electrical conductor.

4. The electrical connector of claim 3, wherein the lock includes a second side opposite the first side having teeth, and wherein the teeth of the second side are configured to engage the other of the fastener and the electrical conductor.

5. The electrical connector of claim 4, wherein the lock is a washer.

6. The electrical connector of claim 2, wherein a maximum dimension of the lock is less than a diameter of the threaded aperture such that the lock non-threadably engages the threaded aperture.

7. The electrical connector of claim 1, wherein the terminal block is an L-shaped terminal block including a first portion and a second portion, and wherein the first portion is configured to extend further from the support surface of the electrical device than the second portion.

8. The electrical connector of claim 7, wherein the connecting aperture and the threaded aperture are formed within the first portion of the terminal block, and wherein the second portion includes a mounting aperture configured to receive a fastener to fasten the electrical connector to the electrical device.

9. An electrical connector configured to couple an electrical conductor to a support surface of an electrical device, the electrical connector comprising:

a terminal block including a connecting aperture and a threaded aperture, the connecting aperture configured to receive the electrical conductor;

a lock including threads to be receivable within the threaded aperture, the lock configured to move in a first rotational direction about an axis to secure the electrical conductor against movement relative to the terminal block, the lock configured to move in a second rotational direction about the axis to release the electrical conductor from the terminal block; and a locking fastener engageable with the lock, a force being exerted on a portion of one of the lock and the locking fastener in a radial direction relative to the axis to inhibit movement of the lock in the second rotational direction.

10. The electrical connector of claim 9, wherein one of the lock and the locking fastener includes a protrusion, wherein the other one of the lock and the locking fastener includes a recess sized to receive the protrusion, and wherein at least one of the protrusion and the recess is eccentric relative to the axis.

11. The electrical connector of claim 10, wherein the locking fastener includes the protrusion and the lock includes the recess, and wherein the protrusion is eccentric relative to the axis.

12. The electrical connector of claim 9, wherein the locking fastener includes threads to be receivable within the threaded aperture.

13. The electrical connector of claim 12, wherein the lock is configured to be positioned between the locking fastener and the electrical conductor in a direction along the axis.

14. The electrical connector of claim 9, wherein the lock includes a drive portion configured to receive a tool to move the lock in the first rotational direction and the second rotational direction.

15. The electrical connector of claim 9, wherein the locking fastener disengages the lock to permit movement of the lock in the second rotational direction.

16. The electrical connector of claim 9, wherein the terminal block is an L-shaped terminal block including a first portion and a second portion, and wherein the first portion is configured to extend further from the support surface of the electrical device than the second portion.

17. The electrical connector of claim 16, wherein the connecting aperture and the threaded aperture are formed within the first portion of the terminal block, and wherein the second portion includes a mounting aperture configured to receive a fastener to fasten the electrical connector to the electrical device.

18. An electrical connector configured to couple an electrical conductor to a support surface of an electrical device, the electrical connector comprising:

a terminal block including a first aperture and a second aperture, the first aperture configured to receive the electrical conductor;

a locking fastener receivable within the second aperture, the locking fastener configured to move into a first position in which the electrical conductor is secured against movement relative to the terminal block, the locking fastener configured to move into a second position in which the electrical conductor is releasable from the terminal block; and a lock engaging the locking fastener to inhibit movement of the locking fastener from the first position to the second position, the lock disengaging the locking fastener to permit movement of the locking fastener from the first position to the second position.

19. The electrical connector of claim 18, wherein the lock engages the locking fastener such that a force is exerted on a portion of one of the lock and the locking fastener in a radial direction relative to a central axis of the second aperture to inhibit movement of the locking fastener in the second rotational direction.

* * * * *